US006501454B1

(12) United States Patent
Ozawa et al.

(10) Patent No.: US 6,501,454 B1
(45) Date of Patent: Dec. 31, 2002

(54) LIQUID CRYSTAL DEVICE, DRIVING METHOD THEREFOR, AND ELECTRONIC APPARATUS USING THE SAME

(75) Inventors: Yutaka Ozawa, Minowa-Machi (JP); Hiroaki Nomura, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/176,888

(22) Filed: Oct. 22, 1998

(30) Foreign Application Priority Data

Oct. 22, 1997 (JP) ..... 9-307900
Aug. 10, 1998 (JP) ..... 10-238034

(51) Int. Cl.[7] ..... G09G 3/36
(52) U.S. Cl. ..... 345/96; 345/87; 345/208
(58) Field of Search ..... 345/96, 87, 99, 345/97, 208

(56) References Cited

U.S. PATENT DOCUMENTS 5,684,503 A * 11/1997 Nomura et al. ..... 345/97
5,726,677 A * 3/1998 Imamura ..... 345/99
5,959,602 A * 9/1999 Welzen ..... 345/99
6,046,717 A * 4/2000 Taniguchi et al. ..... 345/96

FOREIGN PATENT DOCUMENTS

JP B2-1-51818 11/1989
JP A-6-230751 8/1994 ..... G09G/3/36
JP A-7-175041 7/1995 ..... G09G/3/36

* cited by examiner

*Primary Examiner*—Richard Hjerpe
*Assistant Examiner*—Alexander Eisen
(74) *Attorney, Agent, or Firm*—Oliff & Berridge, PLC

(57) ABSTRACT

A liquid crystal display method is provided in which various types of display patterns can be displayed with a predetermined driving voltage margin being maintained and power consumption does not increase. Accordingly, a driving method for a liquid crystal display device is provided using liquid crystal having two metastable states. A scanning signal has a reset period, a delay period, a selection period and a non-selection period in one frame period. The selection period is set to one horizontal scanning period 1H. The scanning signal is set to reset potentials reversed at an interval of a frame period in the reset period, set to selection potentials reversed at an interval of 1H/2 in the selection period, and set to non-selection potentials in the delay period and the non-selection period. The data potential of a data signal has potentials reversed at an interval of 1H/2. When the voltage difference between the scanning signal and the data signal is applied to the liquid crystal, a voltage having one polarity is not always applied to the liquid crystal for a period exceeding a 1H period in the delay period. Therefore, various display patterns can be displayed with a predetermined driving voltage margin being maintained. Since a voltage applied to the liquid crystal in the reset period is reversed in the positive and negative sides at an interval of a period longer than 1H, power consumption does not increase.

28 Claims, 36 Drawing Sheets

T2
T3(1H)
T4
+Vw
-Vw

COM (i)
0

COM (i+1)
0

SEG (j)
(ALL BLACK)
0
+Vd
-Vd

SEG (j)
(ALL WHITE)
0

SEG (j)
(ONE BLACK DOT)
0

SEG (j)
(ONE WHITE DOT)
0

SEG (j)
(BLACK STRIPE)
0

SEG (j)
(WHITE STRIPE)
0

T2
T3(1H)
T4
+Vw

COM ( i )
0
+Vd

SEG ( j )
(ALL BLACK)
0
0

SEG ( j )
(ALL WHITE)
-Vd
+Vd

SEG ( j )
(ONE BLACK DOT)
0
-Vd
+Vd

SEG ( j )
(ONE WHITE DOT)
0
-Vd
+Vd

SEG ( j )
(BLACK VERTICAL STRIPE)
0
-Vd
+Vd

SEG ( j )
(WHITE VERTICAL STRIPE)
0
-Vd

ALL BLACK

ALL WHITE

ONE BLACK DOT

ONE WHITE DOT

ONE BLACK STRIPE LINE

ONE WHITE STRIPE LINE (i – TH, (i + 1) – TH LINES)

| TWO-LINE DISPLAY | SCANNING-SIGNAL WAVEFORM | DATA-SIGNAL WAVEFORM | DIFFERENTIAL WAVEFORM |
|---|---|---|---|
| ON | | H1 H3 | |
| ON | | | |
| OFF | | H1 H3 | |
| OFF | | | |
| ON | | H1 H3 | |
| OFF | | | |
| OFF | | H1 H3 | |
| ON | | | |

FIG. 34

((i+2)-TH, (i+3)-TH LINES)

| TWO-LINE DISPLAY | SCANNING-SIGNAL WAVEFORM | DATA-SIGNAL WAVEFORM | DIFFERENTIAL WAVEFORM |
|---|---|---|---|
| ON | | H2 H4 | |
| ON | | | |
| OFF | | H2 H4 | |
| OFF | | | |
| ON | | H2 H4 | |
| OFF | | | |
| OFF | | H2 H4 | |
| ON | | | |

FIG. 35

LIQUID CRYSTAL DEVICE, DRIVING METHOD THEREFOR, AND ELECTRONIC APPARATUS USING THE SAME

BACKGROUND OF THE INVENTION

1. Field of Invention

The present invention relates to a bistable liquid crystal device having a memory capability which uses a nematic liquid crystal, a driving method for driving the crystal device, and an electronic apparatus using the liquid crystal device.

2. Description of Related Art

A bistable liquid crystal display using a nematic liquid crystal has already been disclosed in Japanese Examined Patent Publication No. 1-51818. An initial alignment condition, two stable states, and a method for implementing the states are described therein.

In Japanese Examined Patent Publication No. 1-51818, however, only the operations or phenomenon of the two stable states are described, and there is no descriptions on means for practically using the states for a display apparatus. In addition, there is no descriptions on a matrix display, which has now the highest practical capability as a display apparatus and has a high display capability in the publication. A driving method for driving the liquid crystal device is not disclosed either.

The inventors have proposed in Japanese Unexamined Patent Publication No. 6-230751 a method for avoiding the foregoing drawbacks, in which backflow generated in a liquid crystal cell is controlled. In this method, a period in which the Freedericksz transition is generated by applying a high voltage for about one millisecond and immediately after that, a 0-degree uniform state is formed by the use of a constant voltage pulse which is equal to or higher than a threshold voltage with the same or reverse polarity as or to that of the foregoing pulse. Alternatively, in the same way, a period is provided immediately after the Freedericksz transition voltage, in which pulses equal to or lower than the threshold voltage are generated to implement a 360-degree twist state. In this method, the time required for writing per line in a matrix display is 400 $\mu$sec. To write for 400 lines or more, a total time of 160 msec (6.25 Hz) or more is required and this causes a flicker in a display. A practical problem remains in this method.

Therefore, the inventors filed Japanese Unexamined Patent Publication No. 7-175041 to improve the writing time. As shown in FIG. 2 or FIG. 4 in that publication, a delay period is provided after the reset pulse which causes the Freedericksz transition, and then an ON or OFF selection signal is applied. With this method, the writing time can be reduced, for example, to 50 $\mu$sec, which is about several times faster than before.

To make driving of bistable liquid crystal practical, some points are to be improved in addition to the writing time described above.

One of the issues is to implement to display all display patterns which may be displayed on a matrix display screen.

In the method for improving the writing time described above, for example, a scanning voltage signal supplied to the scanning signal line corresponding to a horizontal line has a reset period, a selection period, a non-selection period, and in addition, a delay period disposed between the reset period and the selection period. In this delay period, a voltage depending on the data potential of a pixel in a vertical line (data signal line) is applied to the liquid crystal in the same way as in the non-selection period.

The display patterns which may be displayed described above include an all black or white display pattern in one vertical line, a display pattern in which only one white or black dot is disposed in one vertical line, and a stripe display pattern in which white and black alternate in every dot in one vertical line. In the delay period, the voltage depending on each of these display patterns is applied to the liquid crystal.

It is found from experiments performed by the inventors, which will be described later as comparative examples in detail, that a selection voltage which allows the three display patterns described above to be displayed cannot be specified when the delay period is provided in a scanning signal used in the conventional driving method to drive a bistable liquid crystal. It is supposed that this is caused by a DC voltage application due to an unbalanced polarity of a voltage applied to the liquid crystal in the delay period.

Another issue is related to the power consumption of the bistable liquid crystal which is being driven. To drive the bistable liquid crystal, the preceding writing state needs to be reset in advance before the selection period. In the reset period, it is necessary to apply a reset voltage which is higher than that for other liquid crystal, for example, 25 V. This high reset voltage increases the power consumption of the bistable liquid crystal which is being driven. Therefore, if the power consumption increases due to the improvement of a driving method of the bistable liquid crystal, the driving method cannot be made practical.

SUMMARY OF THE INVENTION

Accordingly, an object of the present invention is to provide a liquid crystal device, a driving method therefor, and an electronic apparatus using the liquid crystal device, in which various types of display patterns can be displayed with a predetermined driving voltage margin being maintained and power consumption being prevented from increasing.

According to the present invention, a driving method for a liquid crystal device which includes a first substrate having a plurality of scanning signal lines, a second substrate having a plurality of data signal lines, and a liquid crystal disposed between the first and second substrates, in which a liquid crystal molecule has a predetermined twist angle at an initial state and there exist two metastable states different from the initial state as relaxation states generated after a voltage for bringing about a Freedericksz transition is applied, the method including:

- supplying a scanning signal having a reset period, a delay period, at least one selection period, and a non-selection period in one vertical scanning period to each of the scanning signal lines;
- supplying a data signal having the data potential corresponding to a display pattern to each of the data signal lines every time in the at least one selection period;
- applying a voltage difference between the data signal and the scanning signal to the liquid crystal which is set to a reset potential at the reset period, set to a selection potential at the at least one selection period, and set to a non-selection potential at the delay period and at the non-selection period;
- applying a reset voltage higher than or equal to a threshold value to the liquid crystal for bringing about the Freedericksz transition in the reset period according to the reset potential of the scanning signal and the data potential of the data signal;

applying a delay voltage to the liquid crystal in the delay period after the reset period according to the non-selection potential of the scanning signal and the data potential of the data signal;

applying a selection voltage to the liquid crystal for selecting one of the two metastable states in the at least one selection period after the delay period according to the selection potential of the scanning signal and the data potential of the data signal;

applying a non-selection voltage to the liquid crystal at the non-selection period following the at least one selection period according to the non-selection potential of the scanning signal and the data potential of the data signal;

setting the length of the at least one selection period to one horizontal scanning period (1H), and respectively setting the selection potential of the scanning signal and the data potential of the data signal corresponding to each selection period to positive and negative potential levels reversed in the positive and negative sides relative to the reference potential at an interval of 1H/m (m is an integer equal to or more than 2) so that a voltage of one polarity is not applied to the liquid crystal exceeding a 1H period irrespective of the display pattern in the delay period, the selection period, and the non-selection period; and reversing the reset voltage in polarity in the positive and negative sides relative to the reference potential at an interval of a period longer than one horizontal scanning period (1H).

A device according to the present invention is defined as a liquid crystal device which implements the above method.

The present invention implements all display patterns which include, for example, an all black or white display pattern in one vertical line, a display pattern in which only one white or black dot is disposed in one vertical line, and a stripe display pattern in which white dots and black dots alternate in one vertical line. It was found from experiments of the inventors that if the voltage applied to the liquid crystal during the delay period continues to be applied with one polarity, an adverse effect appears which impedes display selection during the selection period following the delay period. Therefore, according to the present invention, a voltage with one polarity is not applied to the liquid crystal for more than a period of 1H during the delay period immediately before the selection period, irrespective of the display pattern which determines the display state of the liquid crystal. As a result, all these display patterns are allowed to be displayed.

To this end, the selection potential of a scanning signal and the data potential of a data signal are set to positive and negative potential levels alternately changed between the positive and negative sides at an interval of 1H/m (m is an integer equal to or more than 2) relative to the reference potential. In addition, the reset voltage applied to the liquid crystal during the reset period is alternately changed between the positive and negative sides at an interval of a period longer than one horizontal scanning period (1H). Since an increase of the number of times the polarity of the reset voltage alternates, which is relatively high, is prevented in this way, the total amount of the current which flows when the polarity of the reset voltage alternates is reversed is reduced and an increase of power consumption is also prevented.

It is preferred that the polarity of the reset voltage be changed at an interval of the vertical scanning period, or at a cycle of 2H or more. In this case, since the number of times the polarity of the reset voltage alternates, which is high, is reduced, power consumption is reduced.

It is preferred that the reset period of the scanning signal be divided into a plurality of periods, including at least a first period to a third period, be set to the positive or negative potential level having different polarities from each other relative to the reference potential in the first and third periods, and be set to the reference potential in the second period.

In this case, a voltage to be applied between adjacent scanning electrodes can be reduced. Even if the distance between adjacent scanning electrodes becomes short, it is unnecessary to have a large insulation voltage between the electrodes.

The present invention can also be applied to an MLS (multi-line selection) driving method. In this case, a scanning signal has a plurality of selection periods in one vertical scanning period. In the MLS driving method, the selection voltage is applied at the same time to the liquid crystal corresponding to a plurality of different scanning electrodes in each selection period. Each data potential of a data signal corresponding to each selection period of a scanning signal is set to a positive or negative potential level alternately changed between the positive and negative sides relative to the reference potential at an interval of 1H/m.

The data potential of a data signal used in the MLS driving method is determined by a combination of each of the display states of the simultaneously selected lines and set to the same potential as the reference potential in the data potential. It was found that, with the synergy of this condition and the condition in which the data potential is reversed at an interval of 1H/m, a wide driving voltage margin can be obtained. Since a one-polarity voltage is not continuously applied to the liquid crystal during the delay period irrespective of the display pattern, various types of display patterns can be easily displayed.

It is preferred that a scanning signal used in the MLS driving method has an interval period as the reference potential, between two selection periods provided in one vertical scanning period. With this setting, it can be set that a one-polarity voltage is not applied to the liquid crystal for more than a period of 1H irrespective of the display pattern.

It is preferred that the delay period be set to ranges from 210 $\mu$sec to 700 $\mu$sec. It was found that the saturation voltage Vsat and the threshold voltage Vth of a liquid crystal change according to the length of the delay period, and the voltage difference |Vsat−Vth| therebetween also changes. To generate the liquid crystal arrangement corresponding to a display ON state, an ON voltage applied to the liquid crystal needs to be higher than Vsat. To generate the liquid crystal arrangement corresponding to a display OFF state, an OFF voltage applied to the liquid crystal needs to be lower than Vth. It was found that the voltage difference |Vsat−Vth| needs to be small and the delay period needs to be set to that described above in order to satisfy these conditions. Therefore, the arrangement of the liquid crystal corresponding to the ON/OFF display state can be controlled by setting the length of the delay period as described above.

BRIEF DESCRIPTION OF THE DRAWINGS

FIG. 34 is a characteristic chart showing the waveforms of two scanning signals COM(i) and COM(i+1) shown in FIG. 33, data signal waveforms, and the differential waveforms thereof.

FIG. 35 is a characteristic chart showing the waveforms of the other two scanning signals COM(i+2) and COM(i+3) shown in FIG. 33, data signal waveforms, and the differential waveforms thereof.

DETAILED DESCRIPTION OF PREFERRED EMBODIMENTS

Figure 1:
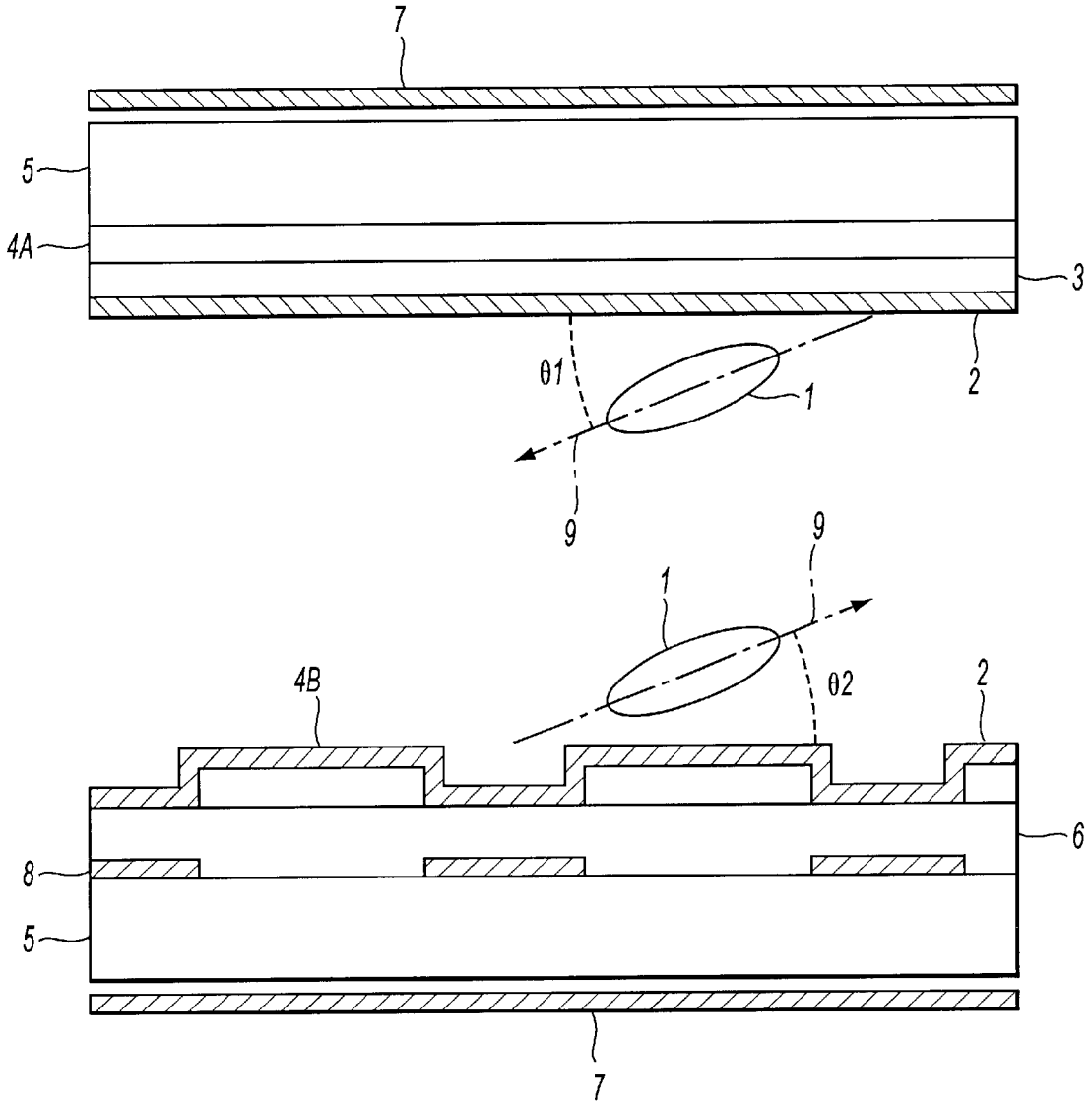
FIG. 1 is an outlined cross section showing the structure of a liquid crystal cell of a liquid crystal display device according to an embodiment of the present invention.

Embodiments of the present invention will be described below by referring to the drawings.

Structure of Liquid Crystal Cell

The liquid crystal material used in each embodiment described later was formed by adding an optical activator (for example, S-811 produced by E. Merck & Co., Inc.) to a nematic liquid crystal (for example, ZLI-3329 produced by E. Merck & Co., Inc.) to adjust the helical pitch of the liquid crystal to 3 to 4 $\mu$m. As shown in FIG. 1, patterns made from ITO, which served as transparent electrodes 4A and 4B, were formed on upper and lower glass substrates 5. Polyimide alignment films 2 (for example, SP-740 produced by Toray Industries, Inc.) were applied thereon. Rubbing treatment was applied to the polyimide alignment films 2 in respective directions which were different by a predetermined angle $\phi$($\phi$=180 degrees in the present embodiment) to form a panel. A spacer was inserted between the upper and lower glass substrates 5 to make the substrate distance even. For example, the substrate distance (cell distance) was set to 2 $\mu$m or less. Therefore, the ratio of the thickness of a liquid crystal layer to the twist pitch is 0.5±0.2.

When liquid crystal is put into this liquid crystal panel, the pre-tilt angles $\theta$1 and $\theta$2 of a liquid crystal molecule 1 become several degrees and the liquid crystal obtains a twist state with an initial alignment of 180 degrees. This liquid crystal panel was sandwiched by two polarizers 7 having different polarization directions shown in FIG. 1 to form a display unit. There is also shown an insulation layer 3, a flattening layer 6, light-shielding layers 8 between pixels, and a director vector 9 of the liquid crystal molecule 1. The flattening layer 6 and the light-shielding layers 8 can be formed as required. A transparent electrode may also be formed on a substrate 5 instead.

A plurality of row electrodes (also called scanning signal lines) extending in the row directions are, for example, formed as the transparent electrode 4A on one substrate 5, a plurality of column electrodes (also called data signal lines) extending in the column directions are, for example, formed as the transparent electrode 4B on the other substrate 5, and the voltage difference of the signals supplied to both electrodes is applied to a liquid crystal layer to control the liquid crystal arrangement thereof corresponds to the display ON/OFF states.

Description of Liquid Crystal Display Device

Figure 27:
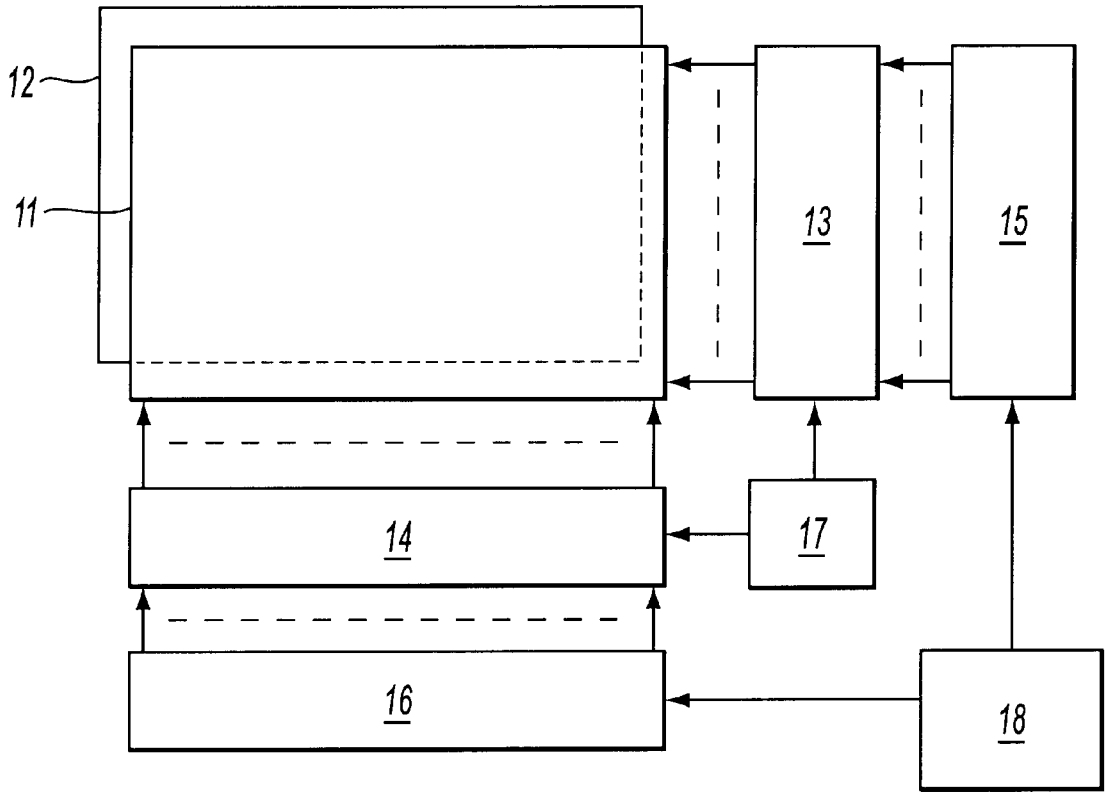
FIG. 27 is a block diagram of a liquid crystal display device according to the present invention.

FIG. 27 shows a simple-matrix liquid crystal display device using the liquid crystal cell shown in FIG. 1. In FIG. 27, the liquid crystal display device is of a transmission type in which a backlight 12 is disposed at the back of the liquid crystal cell 11. The scanning signal lines (row electrodes) formed on one substrate 5 of the liquid crystal panel 11 are connected to a scanning driving circuit (scanning signal supplying device) 13. This scanning driving circuit 13 is controlled by a scanning control circuit 15. On the other hand, the data signal lines (column electrodes) formed on the other substrate 5 of the liquid crystal panel 11 are connected to a signal driving circuit (data signal supplying device) 14. This signal driving circuit 14 is controlled by a signal control circuit 16. Predetermined voltages are applied from a potential setting circuit 17 to the scanning driving circuit 13 and the signal driving circuit 14. A reference clock signal and predetermined timing signals are supplied from a line-sequential scanning circuit 18 to the scanning control circuit 15 and the signal control circuit 16. Potential setting device according to the present invention is formed of the scanning control circuit 15, the signal control circuit 16, the potential setting circuit 17, and the line-sequential scanning circuit 18.

Liquid Crystal Driving Method According to a First Embodiment

Figure 2:
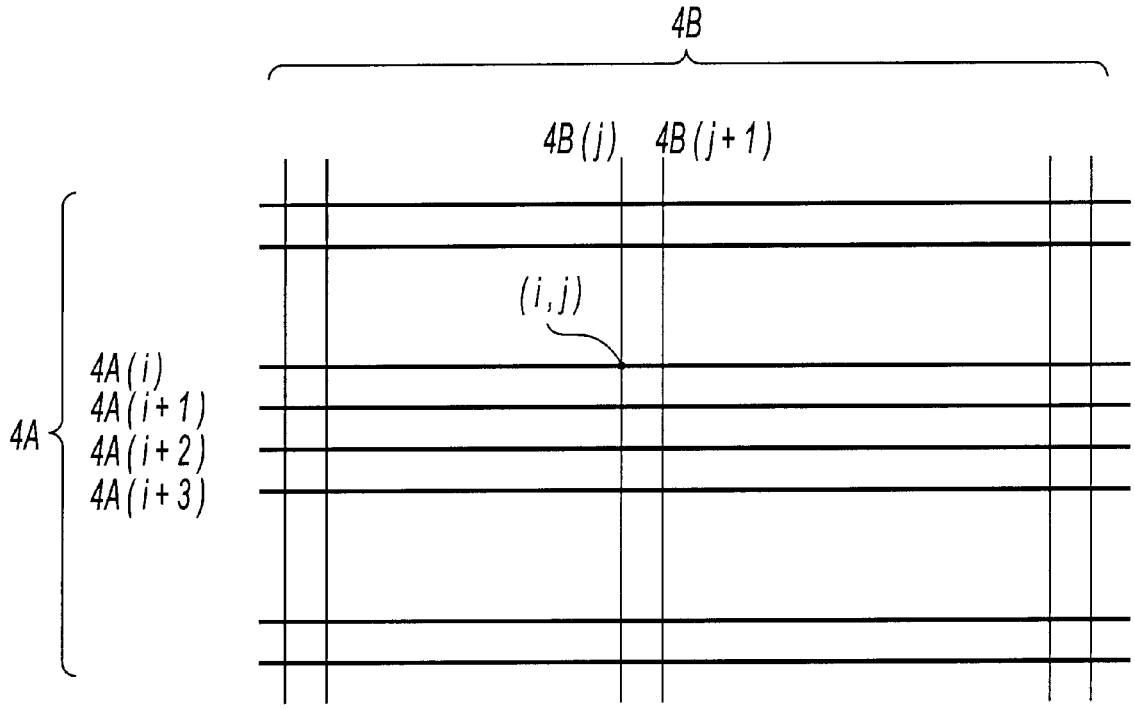
FIG. 2 is an outlined schematic diagram showing the relationship between a plurality of scanning signal lines and a plurality of data signal lines, and pixels connected thereto.

FIG. 2 shows the relationship between a plurality of scanning signal lines 4A and a plurality of data signal lines 4B, and pixels connected thereto. The pixels (i, j) connected to the i-th scanning signal line 4A(i) and the j-th data signal line 4B(j) is driven according to the voltage difference between a scanning signal COM(i) and a data signal SEG(j) supplied to both electrodes 4A(i) and 4B(j).

Figure 3A:
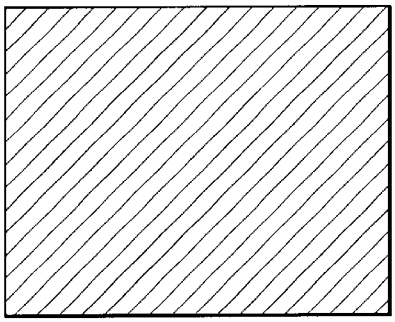
FIGS. 3(A) to 3(F) are outlined schematic diagrams showing different display patterns.
Figure 3B:
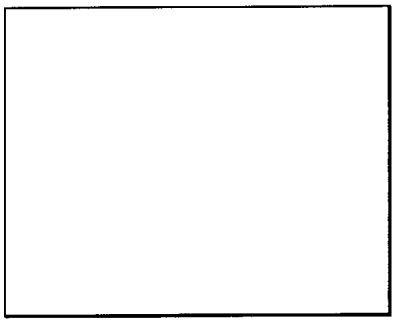
Figure 3C:
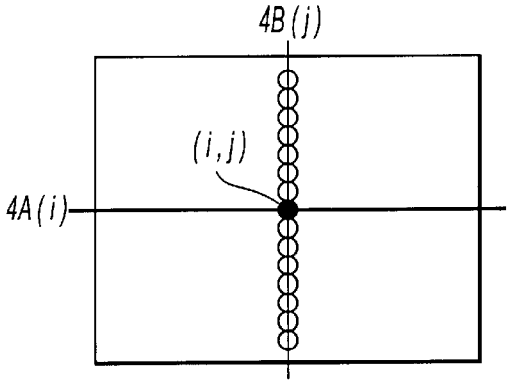
Figure 3D:
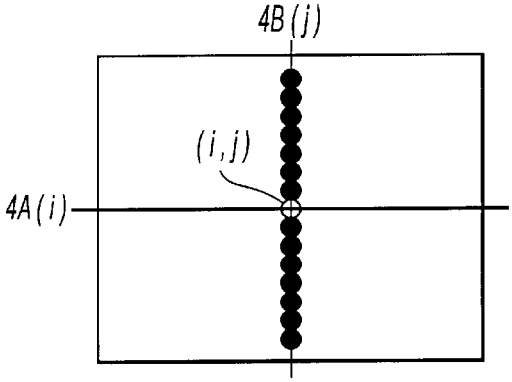
Figure 3E:
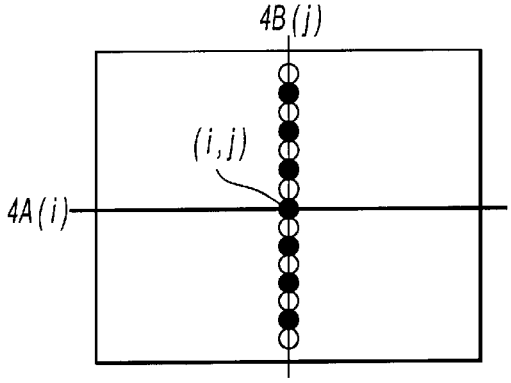
Figure 3F:
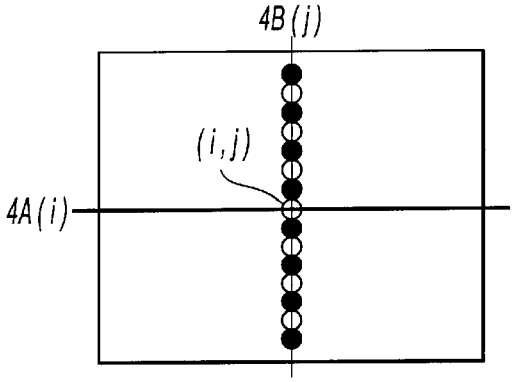

FIGS. 3(A) to 3(F) show examples of display patterns different from each other. FIG. 3(A) shows an example of an all black display pattern (hatching indicates black), FIG. 3(B) shows an example of an all white display pattern, FIG. 3(C) shows an example of a display pattern with only the pixel (i, j) having a black dot, FIG. 3(D) shows an example of a display pattern with only the pixel (i, j) having a white dot, and FIGS. 3(E) and 3(F) show examples of display patterns in which white pixels and black pixels alternate in a vertical column connected to the data signal line 4B(j). FIG. 3(E) has a black dot at the pixel (i, j) whereas FIG. 3(F) includes a white dot at the pixel (i, j).

Figure 4:
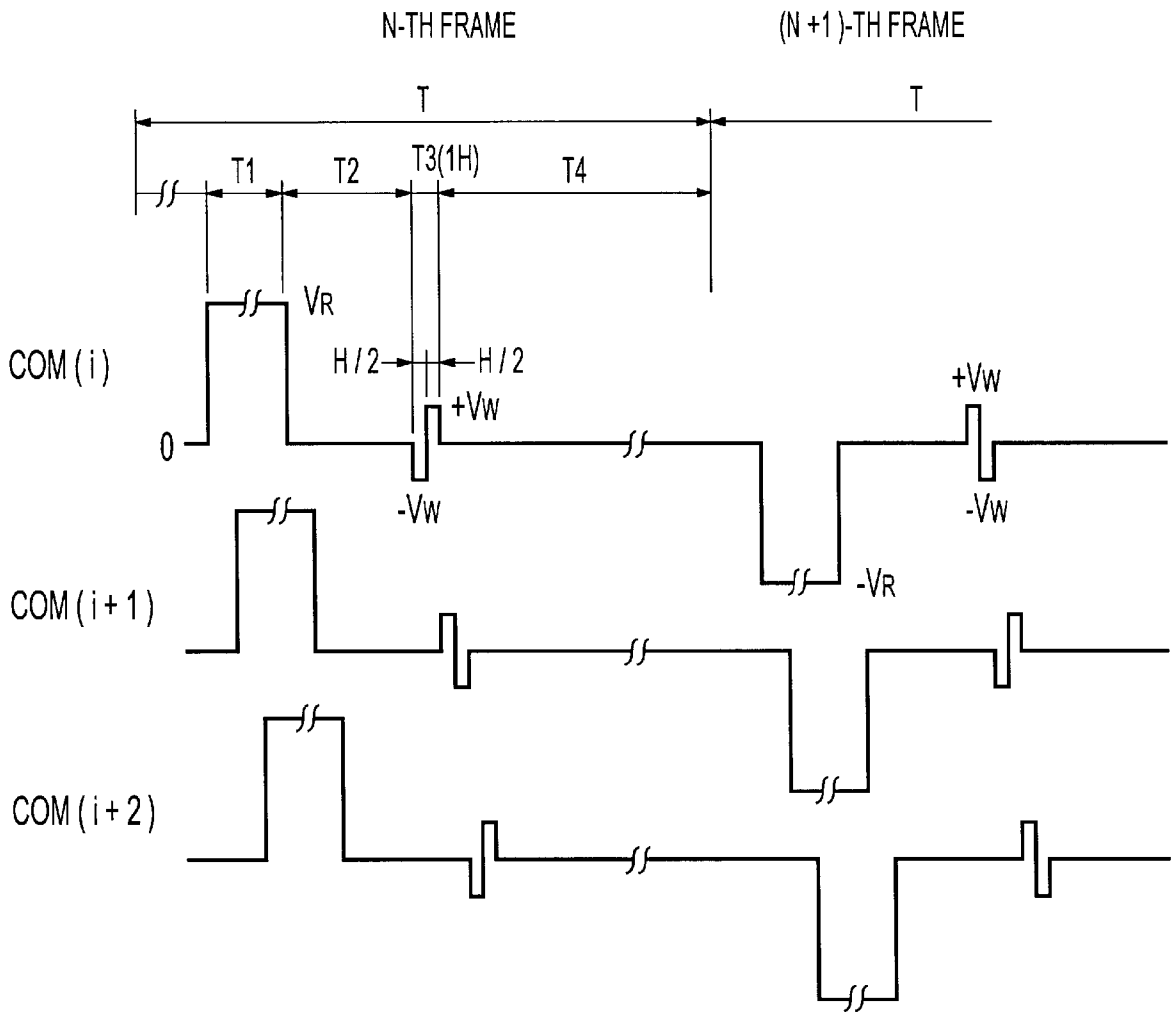
FIG. 4 is a waveform chart showing the waveforms of scanning signals used in common for displaying the patterns shown in FIGS. 3(A) to 3(F) according to the first embodiment.

FIG. 4 indicates scanning signal waveforms shared for the display patterns shown in FIGS. 3(A) to 3(F). There are shown scanning signals COM(i), COM(i+1), and COM(i+2) supplied to scanning electrodes 4A(i) to 4A(i+2) respectively. Each scanning signal has a reset period T1, a delay period T2, a selection period T3, and a non-selection period T4. The period formed by adding these periods T1, T2, T3, and T4 is one vertical scanning period T corresponding to one frame or one field. In the present embodiment, the reset period T1 is set to 1.96 msec, the delay period T2 is set to 350 $\mu$sec, and the selection period T3 is set to 70 $\mu$sec. This selection period T3 corresponds to one horizontal scanning period (1H). Since the number of scanning electrodes driven in one frame period T is 240 and the duty cycle is set to 1/240, one frame period T is 70 $\mu$sec multiplied by 240, which equals 16.7 msec.

The scanning signal COM(i) has a reset potential (±VR) having an absolute value of 15 V or more, which is, for example, set to +25 V or −25 V, at the reset period and a selection potential (±Vw), which is, for example, ±4 V, at the selection period T3. The delay period T2 is set to delay the start of the selection period T3 after the end of the reset period T1. A delay potential is set to 0 V during the period. A non-selection potential at the non-selection period T4, which is used for maintaining the arrangement state of a liquid crystal molecule selected by the voltage applied to the liquid crystal layer during the selection period T3, is also set to 0 V. In other words, the scanning signal COM(i) is set, for example, to 0 V which serves as a constant non-selection potential during the delay period T2 and the non-selection period T4.

The scanning signal COM(i) has a reset potential VR which alternates at every frame between the positive and negative sides relative to a reference potential (0 V), which is the intermediate potential of the amplitude of a data signal described later. In other words, the scanning signal COM(i) has the positive reset potential (+VR) at the N-th frame whereas it has the negative reset potential (−VR) at the (N+1)-th frame. The reset potential is reversed at a frame cycle.

On the other hand, the selection potential is reversed in polarity at an interval (1H/m, where m is an integer equal to or more than 2) shorter than 1H. In other words, the selection potential of the i-th scanning signal COM(i) at the N-th frame is set to the negative potential (−Vw), which has an opposite polarity to that of the positive reset potential (+VR), at the first half (1H/2) period of 1H and is changed to the positive potential (+Vw) at the second half (1H/2) period. The selection potential at the (N+1)-th frame is set to the positive potential, which has an opposite polarity to that of the negative reset potential, at the first half (1H/2) period of 1H and is changed to the negative potential at the second half (1H/2) period. These settings are repeated for every two frames.

Figure 28:
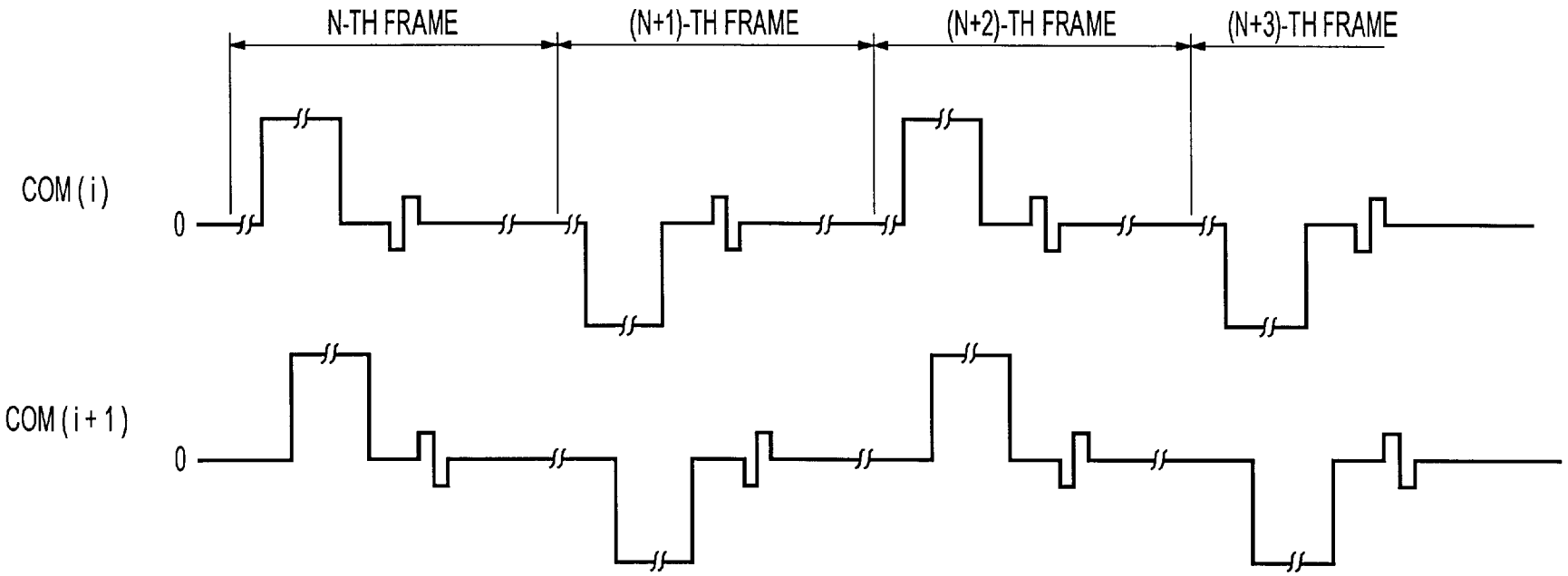
FIG. 28 is a waveform chart showing modifications of the scanning signal waveforms shown in FIG. 4.

Instead of the scanning signal waveforms shown in FIG. 4, scanning signal waveforms having a cycle of four frames as shown in FIG. 28 may be employed. Scanning signals COM(i) and COM(i+1) shown in FIG. 28 have the same voltage waveforms as those shown in FIG. 4 in the N-th and (N+1)-th frames. In the scanning signal waveforms shown in FIG. 28, the polarity of the selection potential is changed from positive to negative after the positive reset potential in the (N+2)-th frame and the polarity of the selection potential is changed from negative to positive after the negative reset potential in the (N+3)-th frame. The scanning signal waveforms are driving waveforms having a cycle of four frames.

The selection potential of any scanning signal shown in FIGS. 4 and 28 is reversed at every scanning signal line (every so-called one line). In other words, the selection potential of the (i+1)-th scanning signal COM(i+1) in the N-th frame is set to have the positive polarity, which is the same as that of the positive reset potential, at the first half (1H/2) period of 1H and is changed to the negative polarity at the second half (1H/2) period. The selection potential at the (N+1)-th frame is set to have the negative polarity, which is the same as that of the negative reset potential, at the first half (1H/2) period of 1H and is changed to the positive polarity at the second half (1H/2) period. In FIG. 28, the scanning signals COM(i) and COM(i+1) have waveforms reversed to each other in a 1H period also in the (N+2)-th and (N+3)-th frames. Since the polarity of the selection potential of a scanning signal is reversed at every line, the (i+2)-th scanning signal COM(i+2) has the same waveform as the i-th scanning signal COM(i) except for a shifted phase.

Figure 5:
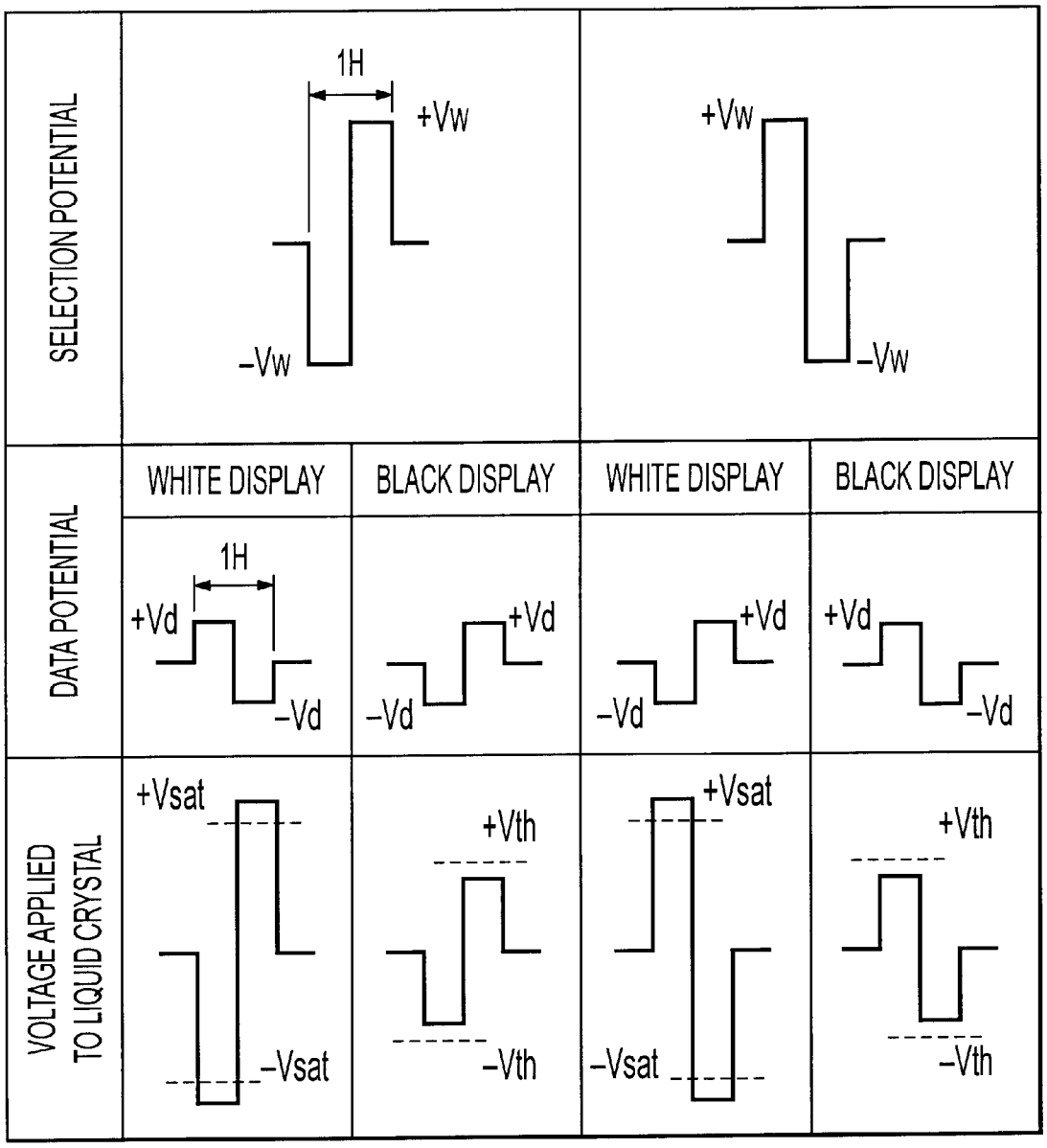
FIG. 5 is a characteristic chart showing the principle of liquid crystal driving in the first embodiment.

A data signal will be described next by referring to FIGS. 5 and 6. FIG. 5 shows selection potentials, data potentials, and a voltage applied to the liquid crystal which is the voltage difference therebetween. As described above, there are two types of selection potentials as shown in the upper row in FIG. 5, one changing from negative to positive in the selection period T3 (1H) and the other changing from positive to negative.

The data potential used as a pair together with the scanning potential changing from negative to positive will be described below. The data potential changes from positive (+Vd) to negative (−Vd) relative to the reference potential (0 V) to display a white dot and changes from negative (−Vd) to positive (+Vd) relative to the reference potential (0 V) to display a black dot as shown in the left part of the intermediate row in FIG. 5. The reference potential here can be defined as the intermediate potential between the positive and negative data potentials, and is not necessarily limited to 0 V.

The absolute value of the voltage applied to the liquid crystal exceeds the saturation voltage Vsat at the positive and negative sides when a white dot is displayed, and is less than the threshold voltage Vth at the positive and negative sides when a black dot is displayed.

The data potential used as a pair together with the scanning potential changing from positive to negative has the relationship opposite to that of the above case as shown in the right part of the intermediate row in FIG. 5.

Figures 6A, 6B, 6C, 6D, 6E, 6F, 6G, 6H:
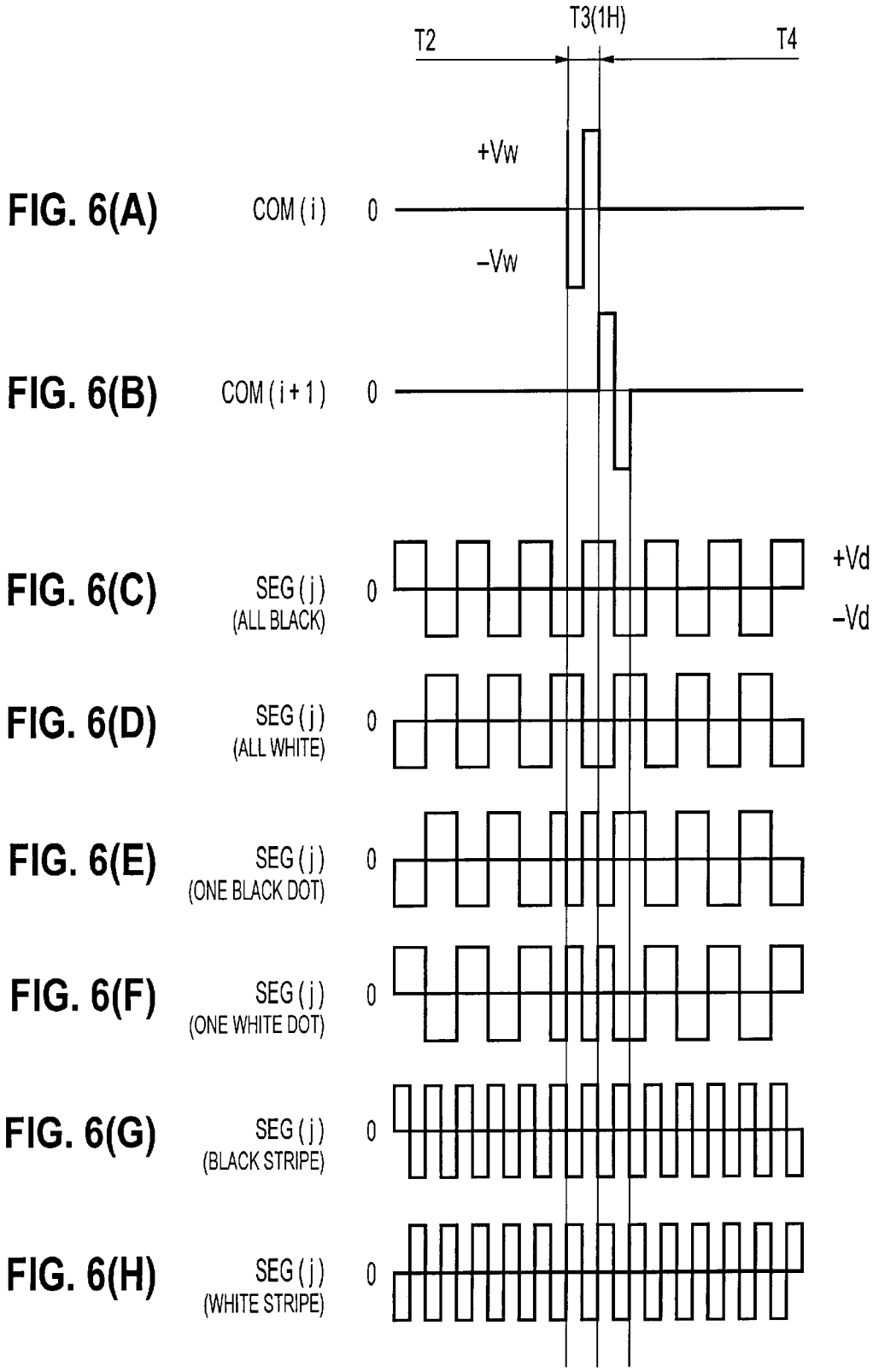
FIGS. 6(A) to 6(H) are waveform charts showing the waveforms of scanning signals and data signals used for implementing each of the display patterns shown in FIGS. 3(A) to 3(F) in the first embodiment.

According to these relationships, the signal waveform of a data signal SEG(j) used for implementing each of the display patterns shown in FIGS. 3(A) to 3(F) will be described by referring to FIGS. 6(A)–(H). FIGS. 6(A) and 6(B) show part of scanning signals COM(i) and COM(i+1) which have selection potentials changing from negative to positive or from positive to negative at every 1H/2. It is found that the waveforms of these scanning signals in the selection period are reversed at every horizontal scanning line. The data signal SEG(j), which is used as a pair together with the scanning signal COM(i) and is used for implementing each of the display patterns shown in FIGS. 3(A) to 3(F), is indicated in FIGS. 6(C) to 6(H). In other words, each data signal SEG(j) has potential levels reversed in positive and negative at every 1H/2 in one horizontal scanning period (1H). When a white dot or a black dot continues, a potential level having one polarity, positive or negative, lasts for a 1H period, as shown in FIGS. 6(C) to 6(F). In each of these display patterns, however, the signal waveform does not have one polarity for a period exceeding 1H. The voltage applied to the liquid crystal alternates such that it is reversed in a 1H period.

Figure 7:
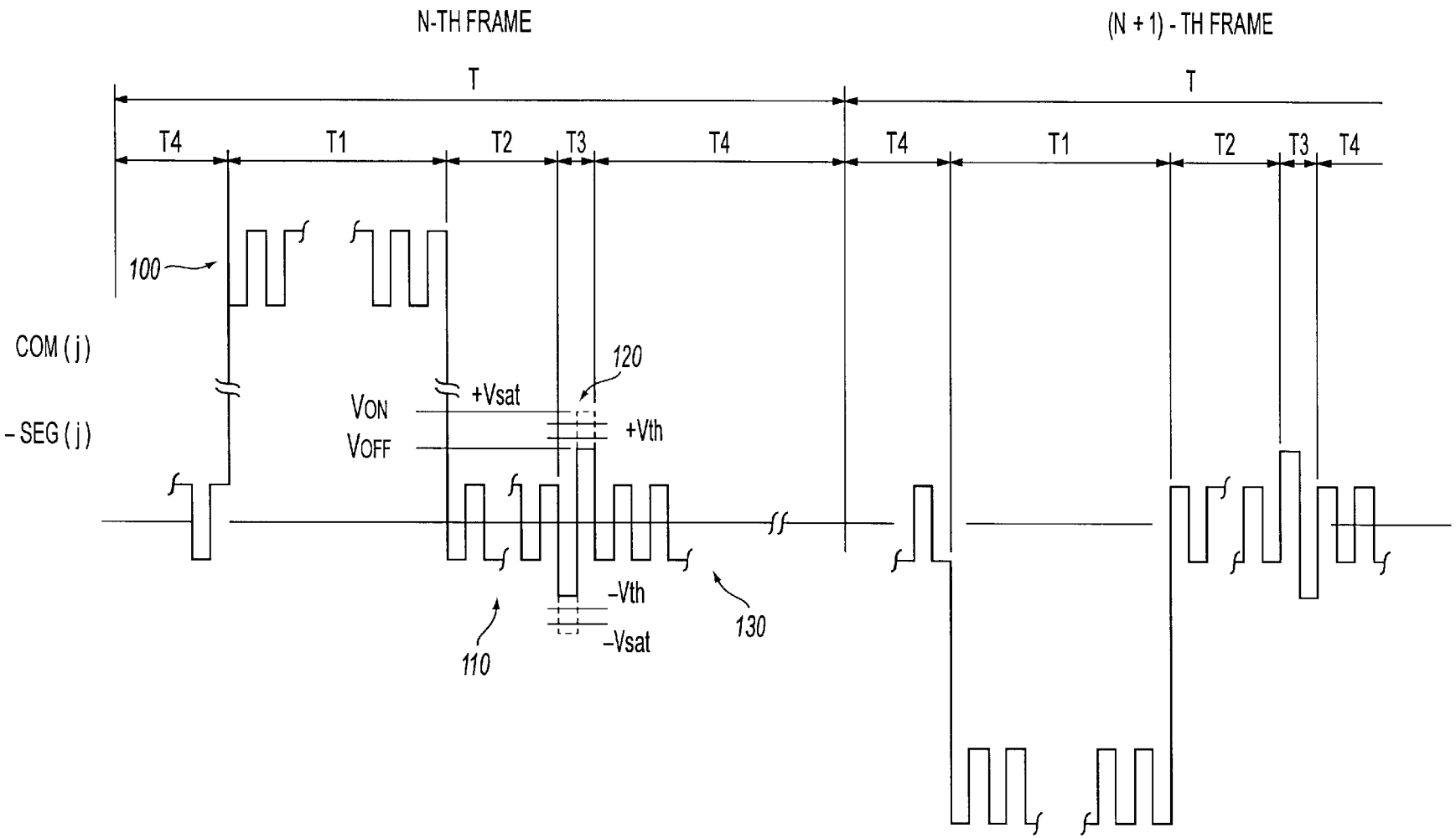
FIG. 7 is a liquid crystal-drive waveform chart showing the waveform of a voltage applied to a liquid crystal in a driving method according to the first embodiment of the present invention.

FIG. 7 indicates the voltage difference between the scanning signal COM(i) shown in FIG. 6(A) and the data signal SEG(j) shown in FIG. 6(G), which is a combined voltage waveform to be applied to the liquid crystal of the pixels (i, j).

In FIG. 7, the difference signal COM(i)–SEG(j), which is to be applied to the liquid crystal, has the following various voltages. In the reset period T1, a reset voltage 100 equal to or higher than the threshold voltage for generating a Freedericksz transition to a nematic liquid crystal is applied. This reset voltage 100 is 24 V or 26 V in the N-th frame and −24 V or −26 V in the (N+1)-th frame. In the delay period T2, a voltage of ±1 V is applied as a delay voltage 110 at every 1H/2. A selection voltage 120 applied to the liquid crystal panel in the selection period T3 is selected with a critical value as a reference which generates one of the two metastable states of the nematic liquid crystal, for example, substantially a 360-degree twist alignment state and substantially a 0-degree uniform-alignment state. In the present embodiment, when this selection voltage 120 is set to an OFF voltage Voff (3 V in the present embodiment) which is less than the absolute value of the threshold voltage Vth of the nematic liquid crystal, the 360-degree twist alignment state is obtained. When an ON voltage Von (5 V in the present embodiment) which exceeds the absolute value of the saturation voltage Vsat of the nematic liquid crystal is applied to the liquid crystal cell as the selection voltage 120, the 0-degree uniform alignment state is obtained. In the non-selection period T4, a non-selection voltage 130 (+1 V in the present embodiment) which is equal to or lower than the threshold voltage and can maintain the two metastable states is applied to maintain the liquid crystal state selected in the selection period T3.

Description of the Principle of Liquid Crystal Display

Figure 8:
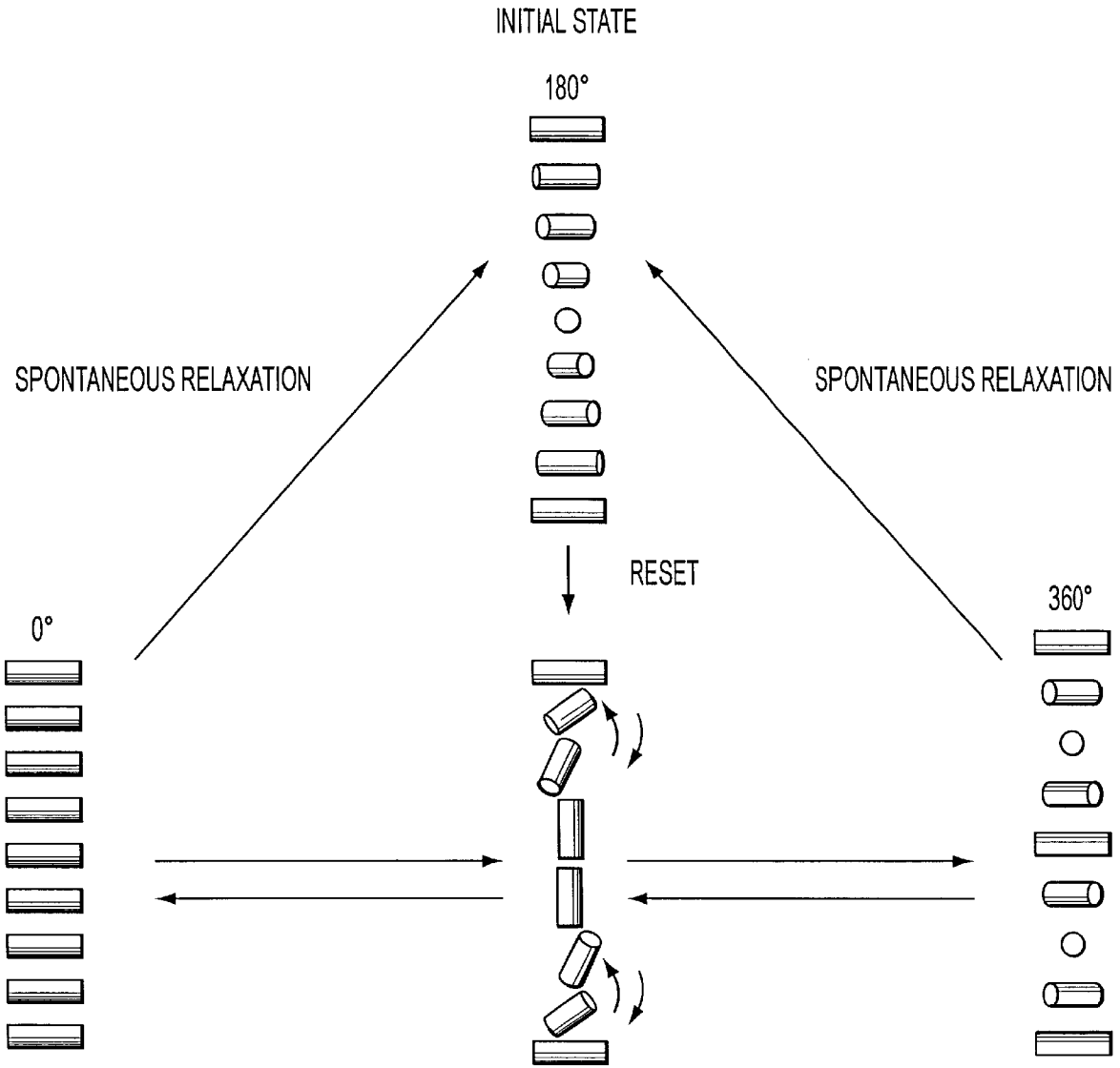
FIG. 8 is an outlined schematic diagram used for describing the behavior of a liquid crystal molecule used in the first embodiment of the present invention.

FIG. 8 is a schematic diagram used for describing various states of a nematic liquid crystal.

This liquid crystal is in a 180-degree twist alignment state generated by the above-described rubbing treatment as the initial alignment state. When the reset voltage 100 is applied to the liquid crystal which is in the initial alignment state in the reset period T1, a Freedericksz transition is brought about as shown in FIG. 8. The reset state shown in FIG. 8 indicates a Freedericksz transition. In other words, the state where the liquid crystal molecules are vertically arrayed against the substrate is the Freedericksz transition.

After that, in the selection period T3, when the ON voltage Von is applied to the liquid crystal as the selection voltage 120, the 0-degree uniform alignment state is obtained. When the OFF voltage Voff is applied in this period, the 360-degree twist alignment state is obtained. After that, as shown in FIG. 8, the liquid crystal is spontaneously relaxed from one of the above two states to the initial state according to a predetermined time constant. The time constant can be set sufficiently long as compared with the time required for display. Therefore, when the non-selection voltage 130, which is to be applied in the non-selection period T4, is maintained to be sufficiently lower than the voltage required to bring about the Freedericksz transition, the state specified in the selection period T3 is substantially maintained until the reset period T1 in the next frame. Consequently, a liquid crystal display is obtained.

Figure 9:
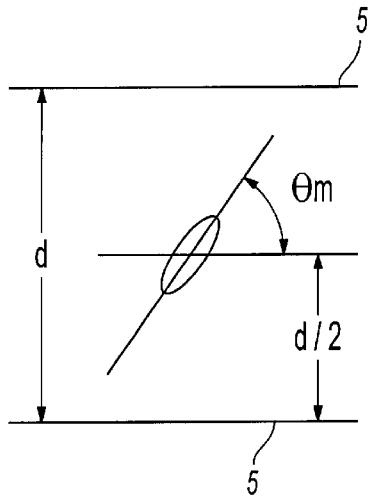
FIG. 9 is an outlined schematic diagram used for describing the tilt angle of a liquid crystal molecule disposed at the center of the liquid crystal cell.

The inventors paid attention to the behavior of a liquid crystal molecule 1 disposed at substantially the center position of the two substrates 5, that is, as shown in FIG. 9, at a distance of d/2 from one of the substrates 5, where d indicates the gap between the two substrates 5, and at the center of the liquid crystal layer in the liquid crystal panel.

Figure 10:
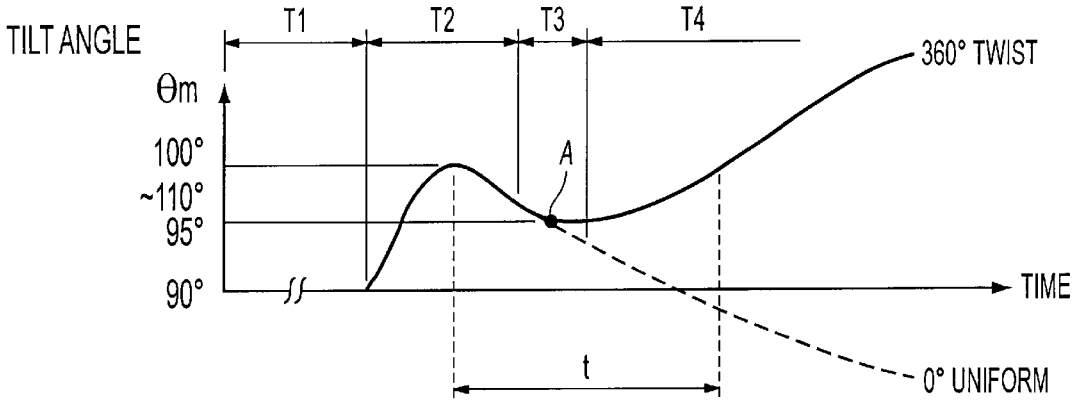
FIG. 10 is a characteristic chart showing changes in the tilt angle in each period of the liquid crystal molecule disposed at the center of the liquid crystal cell shown in FIG. 9.

In FIG. 10, the horizontal axis indicates time and the vertical axis indicates the tilt angle θm of the liquid crystal molecule 1 at the center of the liquid crystal layer in the liquid crystal panel. The tilt angle θm shown in FIG. 9 and FIG. 10 is counted counterclockwise from the horizontal line (0 degrees) parallel to the substrate 5 in a plane parallel to the sheets on which the figures are drawn. In FIG. 10, the tilt angles of vertical liquid crystal molecules adjacent to the two substrates are 0 degrees. They are actually positive tilt angles of predetermined degrees due to rubbing treatment.

In FIG. 10, when the reset voltage 100 which is equal to or higher than the threshold voltage used to brought about the Freedericksz transition is applied to the liquid crystal, the tilt angle θm of the liquid crystal molecule 1 at the center of the liquid crystal layer in the liquid crystal panel becomes almost 90 degrees. The molecule stands perpendicularly (in a homeotropic alignment state) to the substrate 5.

As shown in FIG. 10, the liquid crystal molecule 1 at the center of the liquid crystal layer starts leaning in the direction in which the tilt angle em exceeds 90 degrees, when the reset voltage 100 is released. This phenomenon is called backflow.

The liquid crystal molecule 1 at the center of the liquid crystal layer starts returning in the direction in which the tilt angle θm approaches 90 degrees at a transition point A shown in FIG. 10. According to the magnitude of the applied voltage, the molecule advances in the direction in which the tilt angle θm approaches 0 degrees or in the direction in which the tilt angle θm approaches 180 degrees. The former movement corresponds to a transition to the 0-degree uniform alignment state whereas the latter movement corresponds to a transition to the 360-degree twist alignment state since twisting is applied in addition to this change in the tilt angle θm.

It is clear from the figure that the same behavior is performed through the same process of the backflow in the liquid crystal to the transition point A immediately after the reset voltage 100 is released, both in the transition to the 0-degree uniform alignment state and in the transition to the 360-degree twist alignment state. In other words, due to the backflow of the liquid crystal molecule 1 at the center of the liquid crystal layer, a period absolutely exists in which the molecule has a larger tilt angle θm than that corresponding to the transition point A.

It is important that the selection period T3 be set including the transition point A which is the timing for applying a trigger (selection voltage) after the backflow is brought about in the liquid crystal. If the selection period ends before the transition point A, or if the selection period starts after the transition point A, ON or OFF driving of the liquid crystal cannot be performed.

Even when the selection period T3 is set including the transition point A, if the selection period T3 starts too early, the selection period becomes long, and thereby high-speed driving of a liquid crystal display device having a number of pixels in a line and a low duty ratio becomes impossible.

To this end, it is important to guarantee that the selection period T3 positively starts slightly before the transition point A. This means that when the delay period T2 ends is important.

In the present embodiment, the delay period T2 continues after the end of the reset period T1 until the liquid crystal molecule at the center of the liquid crystal cell has a larger tilt angle θm than that corresponding to the transition point A due to the backflow. As a result, the selection period T3, which starts after the delay period T2, always starts when the liquid crystal molecule at the center of the liquid crystal layer has a larger tilt angle θm than that corresponding to the transition point A.

The inventors found that a larger tilt angle θm than that corresponding to the transition point A ranges from 100 to 110 degrees even if it has a variation due to the liquid crystal material used.

Therefore, in the present embodiment, the delay period T2, which is disposed after the reset period T1, is set to continue until the tilt angle θm of the liquid crystal molecule at the center of the liquid crystal layer becomes at least 100 to 110 degrees. At the start of the selection period T3, which is disposed immediately after this delay period T2, the tilt angle θm of the liquid crystal molecule at the center of the liquid crystal layer is always larger than the tilt angle θm corresponding to the transition point A. The selection period T3 can be started at an appropriate time.

The inventors further found that the tilt angle θm obtained when the liquid crystal molecule at the center of the liquid crystal layer reaches the transition point A is substantially 95 degrees. Therefore, when the delay period T2, which is disposed after the reset period T1, is set to continue until the tilt angle θm of the liquid crystal molecule at the center of the liquid crystal layer becomes at least 100 to 110 degrees and the selection period T3 is set to continue after that until the tilt angle θm of the liquid crystal molecule at the center of the liquid crystal layer becomes substantially 95 degrees, the selection pulse 120 can be always applied close to the transition point A.

The selection pulse 120 to be applied to the selection period T3 needs to be equal to or more than a predetermined effective value. When the selection pulse has a low voltage, the period in which the pulse is applied is set long. Conversely, when the pulse has a high voltage, the period in which the pulse is applied can be short.

From the above consideration, the selection period T3 needs to be set in a period "t" shown in FIG. 10, which is disposed after the tilt angle θm of the liquid crystal molecule at the center of the liquid crystal layer becomes at least 100 to 110 degrees and also needs to surely include the transition point A.

Figure 11:
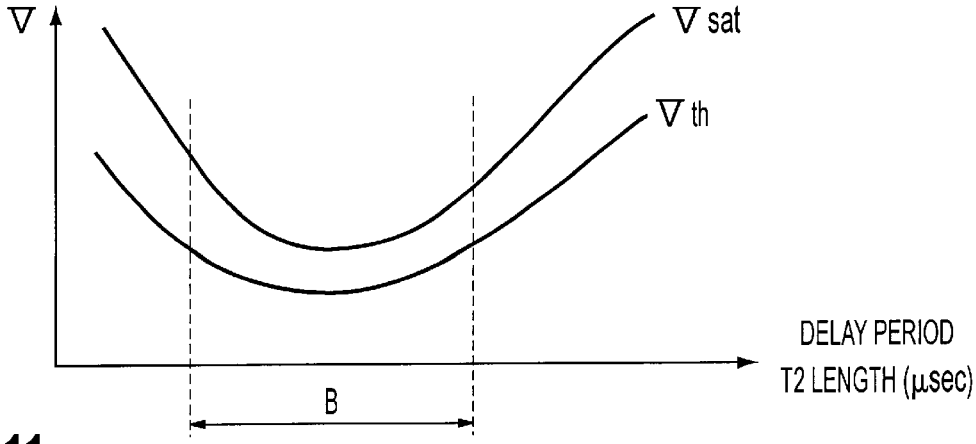
FIG. 11 is a characteristic chart showing the relationship between a saturation voltage and a threshold voltage of the liquid crystal, and a delay period.

The length of the delay period T2 will be considered next. FIG. 11 is a characteristic view showing the relationship between the saturation voltage Vsat and the threshold voltage Vth of the nematic liquid crystal and the delay period T2. The saturation voltage Vsat and the threshold voltage Vth of the nematic liquid crystal change according to the length of the delay period T2. The saturation voltage Vsat and the threshold voltage Vth of the nematic liquid crystal become minimum when the delay period T2 is set to a predetermined length, and increase at different rates with the predetermined length serving as a boundary. Therefore, it is clear from FIG. 11 that the voltage difference |Vsat−Vth| between the saturation voltage Vsat and the threshold voltage Vth of the liquid crystal changes according to the length of the delay period T2. There exists a condition in which the voltage difference |Vsat−Vth| is small as shown by a range B in FIG. 11.

The ON voltage Von for turning the nematic liquid crystal on needs to satisfy the following.

$$Von=Vw+Vd>Vsat$$

At the same time, the OFF voltage Voff for turning the nematic liquid crystal off needs to satisfy the following.

$$Voff=Vw-Vd<Vth$$

To control the arrangement of the liquid crystal corresponding to the display ON/OFF state, the foregoing two conditions need to be satisfied at the same time. It is found that the length of the delay period T2 needs to be in a range in order to satisfy both conditions with a scanning voltage Vw and a data voltage Vd specified generally by a voltage averaging method. When Vw=4×Vd, for example, to satisfy Von=5×Vd>Vsat and Voff=3×Vd<Vth, |Vsat−Vth| needs to be less than 2×Vd. A delay period T2 in which the value of |Vsat−Vth| satisfy this inequality needs to be selected.

When the length of the selection period T3 is set to 70 μsec and this period is defined as 1H, the preferred delay period T2 ranges from 3H to 10H. If the delay period T2 is set, for example, to 2H, which is lower than this lower limit, or to 11H, which is higher than this upper limit, the voltage difference |Vsat−Vth| between the saturation voltage Vsat and the threshold voltage Vth of the liquid crystal becomes too large to satisfy both conditions.

More preferably, when the delay period T2 is specified so that the voltage difference |Vsat−Vth| between the saturation voltage Vsat and the threshold voltage Vth of the liquid crystal becomes substantially the minimum, the delay period T2 ranges from 4H to 8H. When the delay period is specified within this range, since the voltage difference |Vsat−Vth| is small, even if the saturation voltage Vsat and the threshold voltage Vth of the liquid crystal vary according to the temperature, the temperature margin at which the above two conditions are satisfied is extended. Since the voltage difference |Vsat−Vth| is small, the ON/OFF voltage can be set low.

As described above, the delay period T2 preferably ranges from 210 μsec to 700 μsec in the absolute time. It further preferably ranges from 280 μsec to 560 μsec. Even if the selection period T3 is set to a value other than 70 μsec, the delay period T2 expressed above in the absolute time can be applied.

Driving Voltage Margin

In the present embodiment, the reason why the selection voltage applied to the liquid crystal is reversed in polarity at every 1H/2 is that a driving voltage margin is obtained for any of the display patterns shown in FIGS. 3(A) to 3(F) to allow those patterns to be displayed.

Figure 12A:
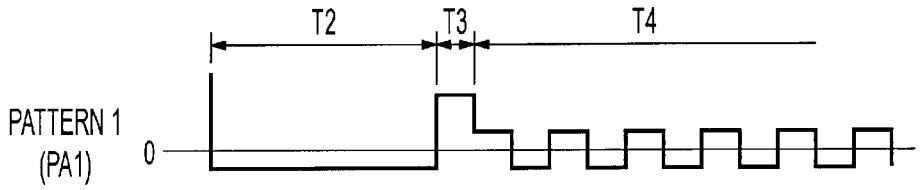
FIGS. 12(A) to 12(C) show the waveforms of voltages applied to the liquid crystal with different delay voltages applied to the liquid crystal during a delay period.
Figure 12B:
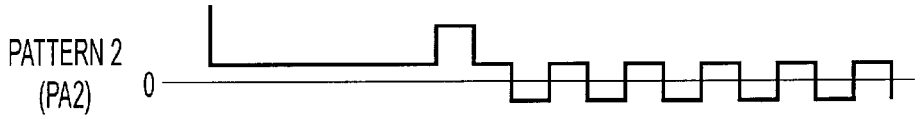

To this end, the inventors obtained an experimental result shown in FIGS. 12(A)–(D) and completed the present invention according to the result. FIG. 12(A) shows the waveform of a voltage applied to the liquid crystal, which has a delay voltage as the negative polarity applied to the liquid crystal during the delay period T2, and is called a pattern 1 (PA1). FIG. 12(B) shows the waveform of a voltage applied to the liquid crystal, which has a delay voltage as the positive polarity applied to the liquid crystal during the delay period T2, and is called a pattern 2 (PA2).

Figure 12C:
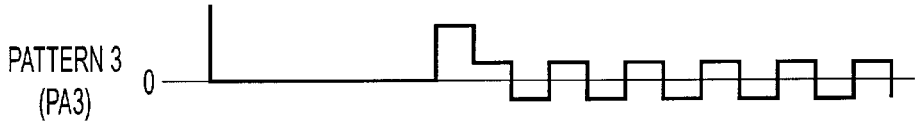

FIG. 12(C) shows the waveform of a voltage applied to the liquid crystal, which has a 0V delay voltage applied to the liquid crystal during the delay period T2, and is called a pattern 3 (PA3).

Figure 12D:
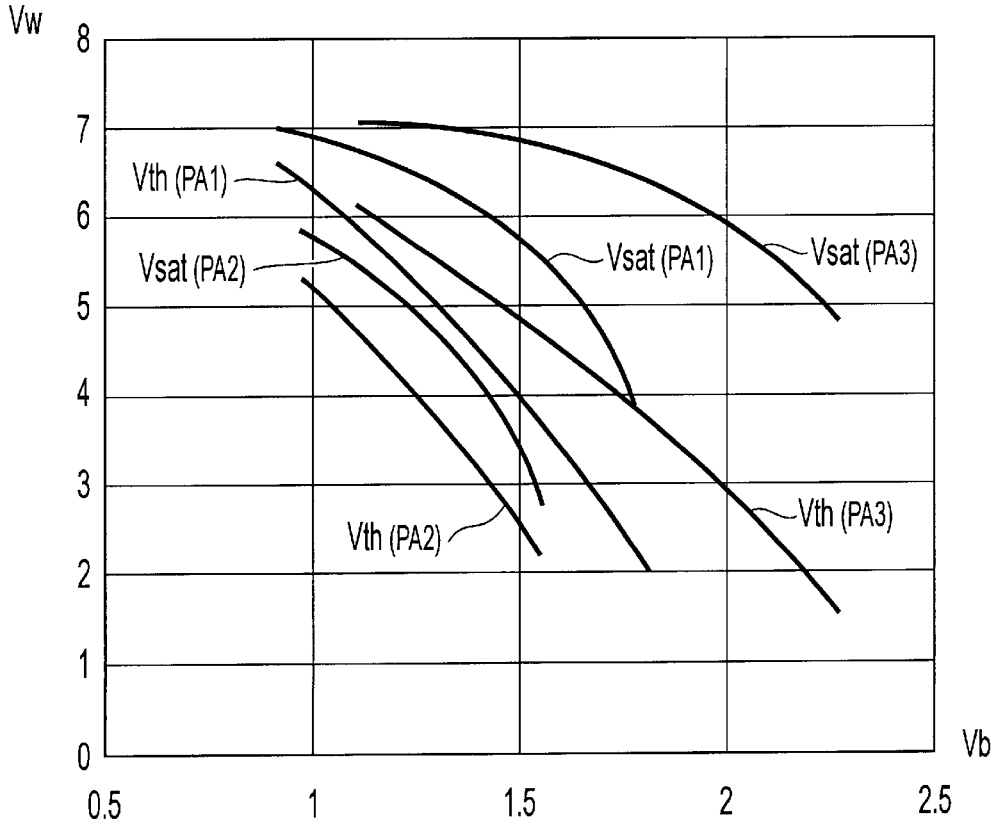
FIG. 12(D) is a characteristic chart showing driving voltage margins measured when the voltages were applied to the liquid crystal.

FIG. 12(D) shows driving voltage margins obtained when the waveforms of the voltages shown in FIGS. 12(A) to 12(C) are applied to the liquid crystal. In FIG. 12(D), the vertical axis indicates the absolute value Vw of the selection potential in a scanning signal shown in FIG. 4, and the horizontal axis indicates a bias voltage Vb. The bias voltage Vb indicates the peak value of the data potential in a data signal relative to the reference voltage (0 V in the present embodiment) of the scanning signal. Since the data potential Vd is set relative to the reference voltage in the present embodiment, Vb=Vd.

The curves of the saturation voltages Vsat for the patterns PA1 to PA3 shown in FIG. 12(D) were obtained by acquiring a limit bias potential Vb (data potential Vd) with which a white dot can be displayed with the selection potential Vw being fixed, and then by repeating this operation with the selection potential Vw being changed. The curves of the threshold voltages Vth for the patterns PA1 to PA3 shown in FIG. 12(D) were obtained in the same way by acquiring a limit bias potential Vb (data potential Vd) with which a black dot can be displayed with the selection potential Vw being fixed, and then by repeating this operation with the selection potential Vw being changed.

A driving voltage margin in each pattern corresponds to a range sandwiched by the curves of the saturation voltage Vsat and the threshold voltage Vth. It is found that the driving voltage margins for the patterns PA1 and PA2 are narrower than that for the pattern PA3. A more important point is that the driving voltage margins for the patterns PA1 and PA2 do not overlap. In other words, when a selection potential Vw and a data potential Vd are specified within the driving voltage margin obtained for the pattern PA1, if the voltage of the pattern PA2 is applied to the liquid crystal under this condition, neither a white dot nor a black dot can be displayed.

Description of a First Comparative Example

Figures 13A, 13B, 13C, 13D, 13E, 13F, 13G:
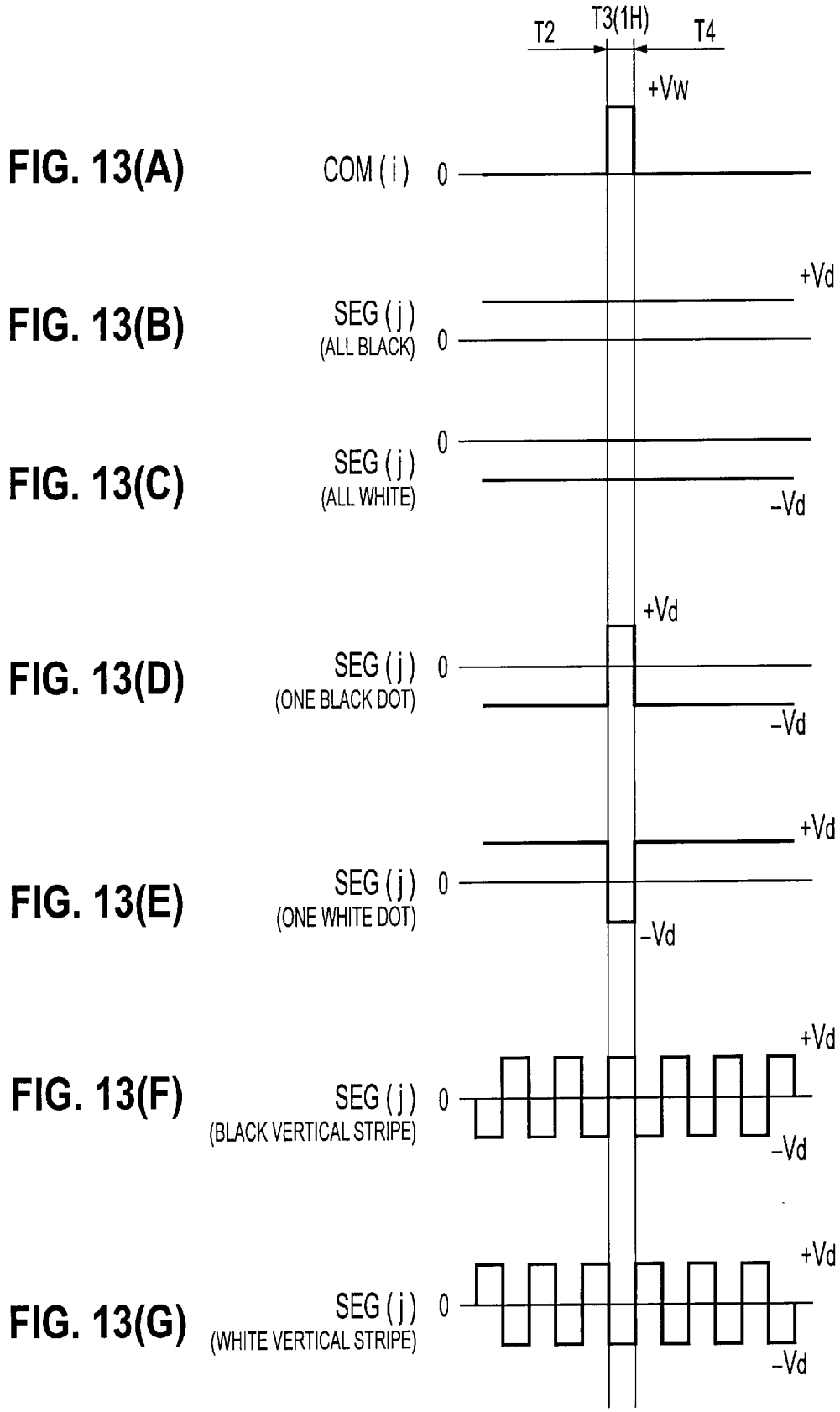
FIG. 13(A) shows the waveform of a scanning signal in the first comparative example.
FIGS. 13(B) to 13(G) show the waveforms of data signals used for implementing each of the display patterns shown in FIGS. 3(A) to 3(F).
Figure 14:
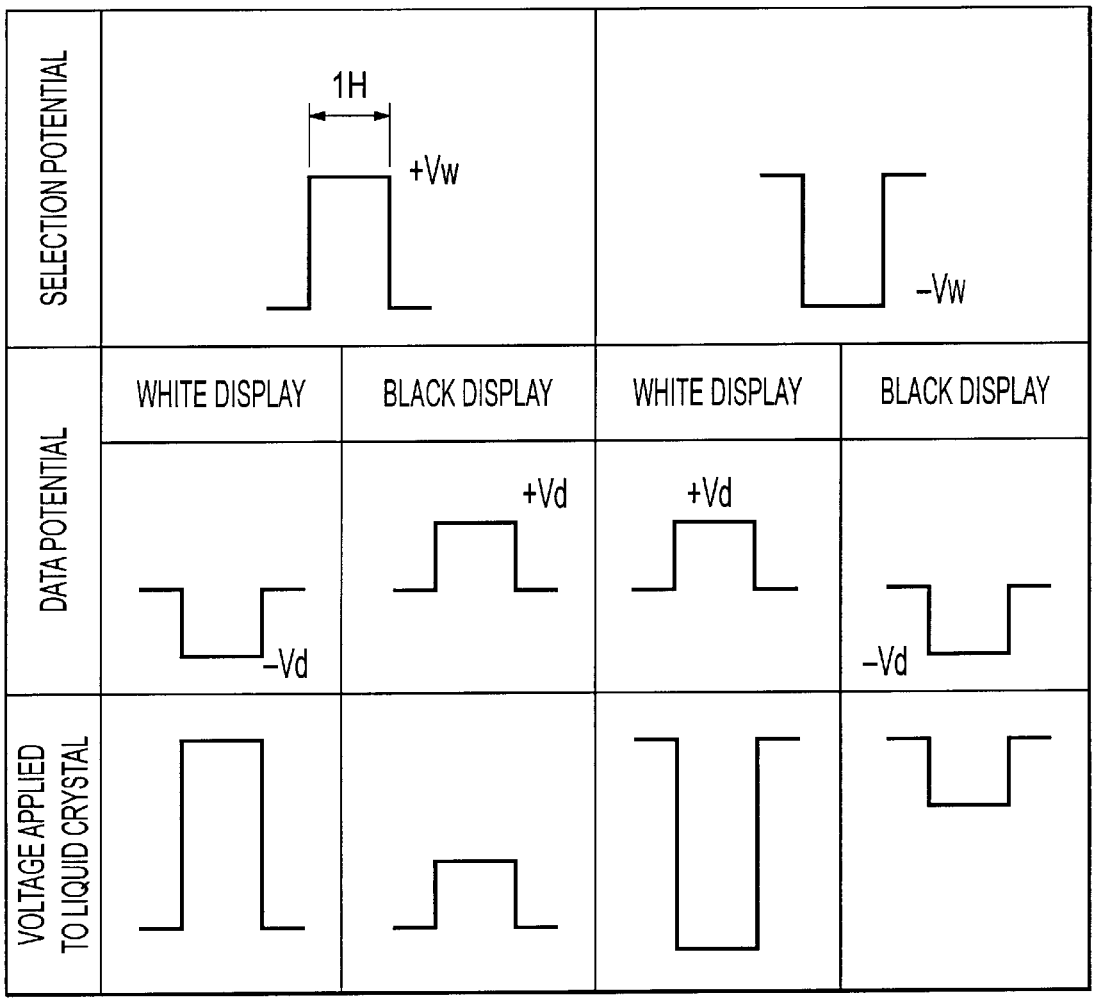
FIG. 14 is a characteristic chart showing the driving principle in the first comparative example.

The waveforms of the patterns PA1 and PA2 shown in FIGS. 12(A) and 12(B) are modeled for a conventional driving method shown in FIGS. 13(A) to 13(G) as a first comparative example. FIG. 13(A) shows the waveform of a scanning signal, which stays at the positive selection potential +Vw without changing in the positive and negative sides in the selection period T1, unlike that shown in FIG. 6(A). Each of the waveforms shown in FIGS. 13(B) to 13(G) is used with the waveform of the scanning signal shown in FIG. 13(A) as a pair, and shows a data signal waveform for implementing each of the display patterns shown in FIGS. 3(A) to 3(F). FIG. 14 shows the driving principle in the first comparative example. A polarity-reverse driving method in which the waveforms shown at the right and left in FIG. 14 are switched at every vertical period and used is employed as the driving method for the first comparative example.

In the driving method for the first comparative example, as shown in FIGS. 13(B) to 13(G), the same driving patterns as or the driving patterns similar to the patterns PA1 and PA2 in FIGS. 12(A) and 12(B) coexist. Therefore, when the selection potential Vw and the data potential Vd are fixed to predetermined potentials, all of the display patterns shown in FIGS. 3(A) to 3(F) cannot be implemented.

Figure 15:
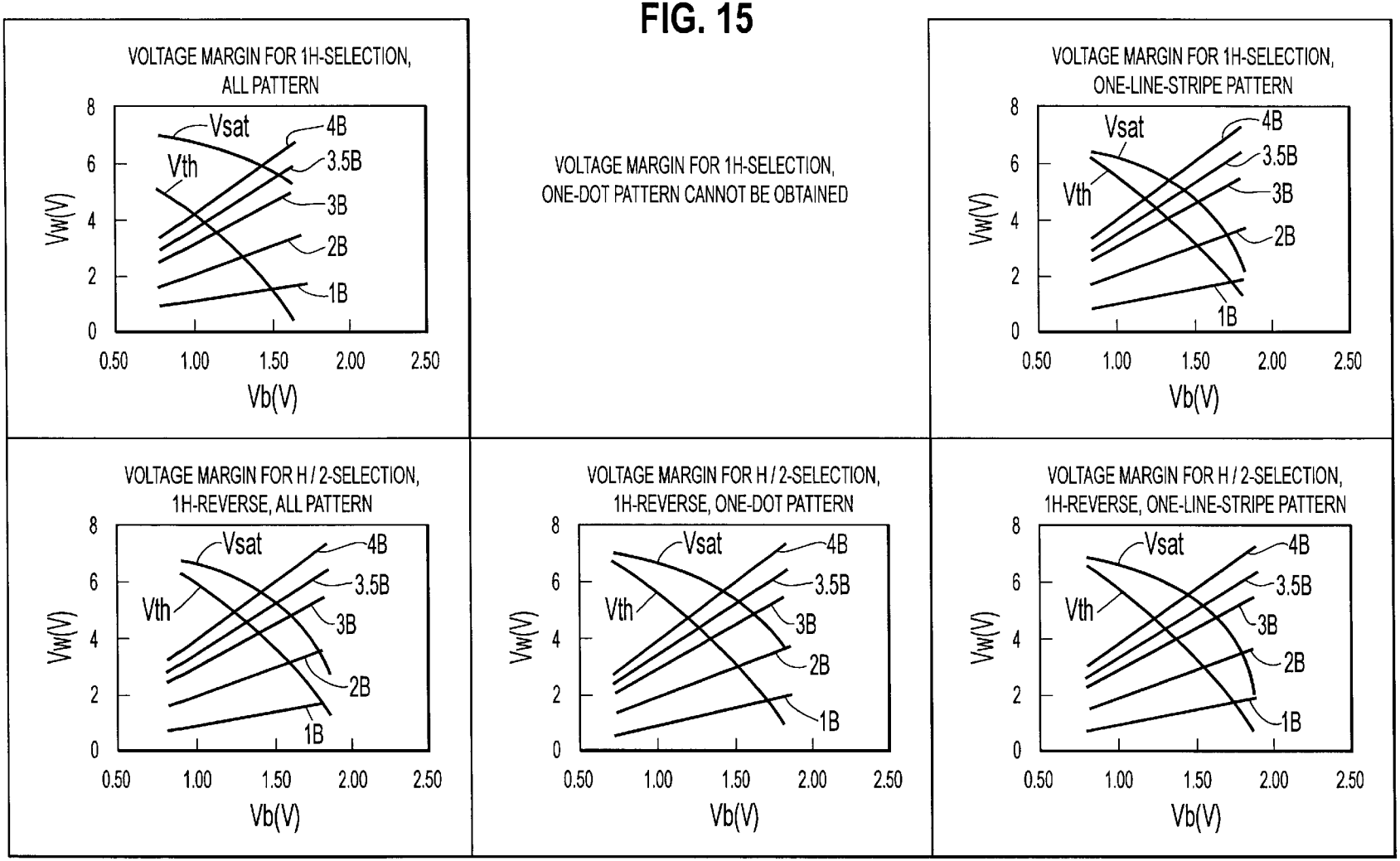
FIG. 15 is a characteristic chart showing driving voltage margins for each of the display patterns in the driving method of the first comparative example and in a driving method of the first embodiment in which a selection potential is changed from the negative side to the positive side.

Driving Voltage Margins for Driving Methods in First Embodiment and First Comparative Example This point was also proved by an experimental result shown in the upper row of FIG. 15. A driving voltage margin for the driving method of the first comparative example is shown at the upper row of FIG. 15. A driving voltage margin for a case in which an all white or all black pattern (corresponding to FIG. 3(A) or FIG. 3(B)) is displayed was measured in the same way as that shown in FIGS. 12(A)–(D) and is shown at the left side of the upper row of FIG. 15. The center of the upper row of FIG. 15 corresponds to a driving voltage margin in a case in which only one white pixel or only one black pixel is displayed (corresponding to FIG. 3(C) or FIG. 3(D)). In this case, a margin was not obtained. A driving voltage margin for a case in which white dots and black dots are alternately displayed in one vertical line (corresponding to FIG. 3(E) or FIG. 3(F)) is shown at the right side of the upper row of FIG. 15. Therefore, it is found that a driving voltage margin common to the cases shown in the right, center, and left of the upper row of FIG. 15 cannot be obtained.

Figure 16:
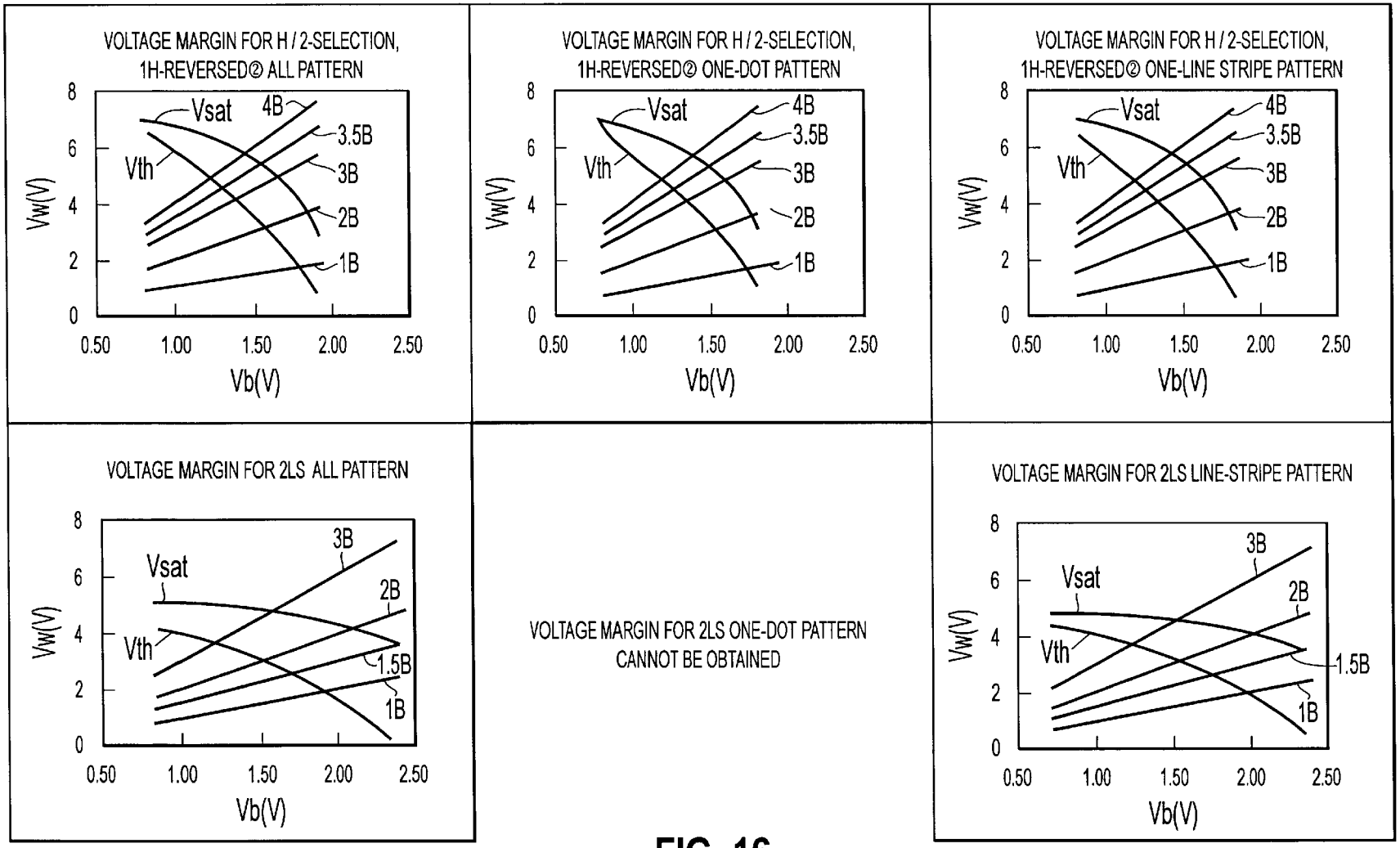
FIG. 16 is a characteristic chart showing driving voltage margins for each of the display patterns in the driving method of the first embodiment in which a selection potential is changed from the positive side to negative side and in a driving method of the second comparative example in which a selection potential is set to have the positive polarity in two selection periods.

Driving voltage margins in a case when the driving method shown in FIGS. 6(A)–(H) in the first embodiment is applied are shown at the lower row of FIG. 15 and at the upper row of FIG. 16 with the same technique. The driving margins shown at the lower row of FIG. 15 and at the upper row of FIG. 16 were measured with the use of the driving method in which the driving waveform at the right side of FIG. 5 and that at the left side of FIG. 5 are switched at every vertical scanning period.

The difference between the driving methods at the lower row of FIG. 15 and at the upper row of FIG. 16 is the polarity relationship between the reset potential and the selection potential. Specifically, both measurements differ in that while the reset potential has the positive polarity, the selection potential changes from negative to positive or the selection potential changes from positive to negative.

It is clearly understood from these figures that a driving voltage margin common to the three display patterns can be obtained in the driving method of the present embodiment.

This is supposed to be because the waveform of the voltage applied to the liquid crystal during the delay period T2 does not change greatly and a DC voltage is not applied (balanced polarity) to the liquid crystal in any of the cases shown in FIGS. 6(B) to 6(G) irrespective of the display patterns. During the delay period T2, the voltages obtained by subtracting the voltages shown in FIGS. 6(C) to 6(H) from the potential (0 V) of the scanning signal shown in FIG. 6(A), that is, the voltage waveforms obtained by reversing the voltages in the positive and negative side in the delay period T2 shown in FIGS. 6(C) to 6(H), are applied to the liquid crystal. In each case, a voltage having one polarity, positive or negative, does not continue to be applied for a period exceeding a 1H period.

Description of Second Comparative Example

A case in which a liquid crystal device according to the present embodiment driven by an MLS (multi-line selection) method will be described as a second comparative example. In the second comparative example, a 2LS (two-line selection) driving method is used in which, for example, two selection periods are set in one vertical period to select pixels connected to two scanning signal lines at two lines at the same time.

Figure 18A:
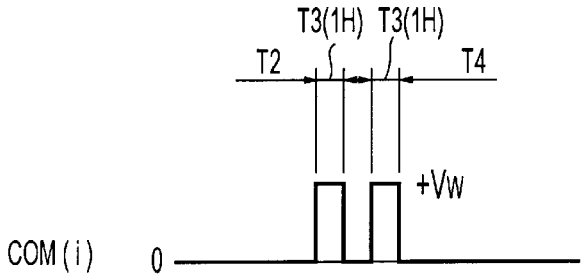
FIGS. 18(A) and 18(B) are waveform charts showing scanning signal waveforms in the second comparative example.
Figure 18B:
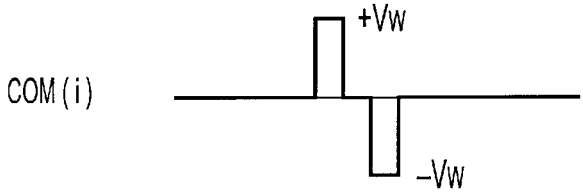
Figure 18C:
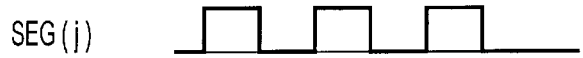
FIGS. 18(C) to 18(H) are waveform charts showing data signal waveforms in the second comparative example corresponding to each of the display patterns shown in FIGS. 3(A) to 3(F).
Figure 18D:
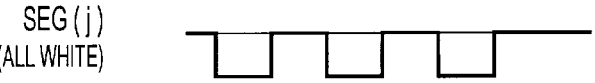
Figure 18E:
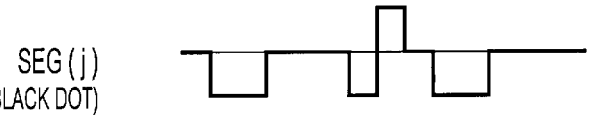
Figure 18F:
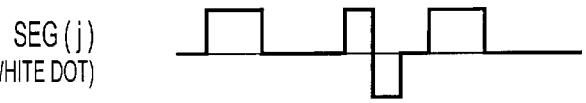
Figure 18G:
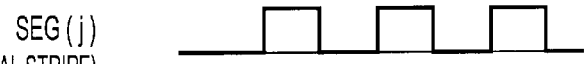
Figure 18H:
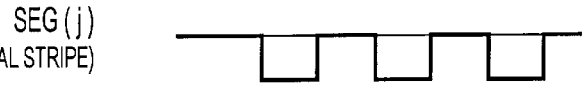
Figure 19A:
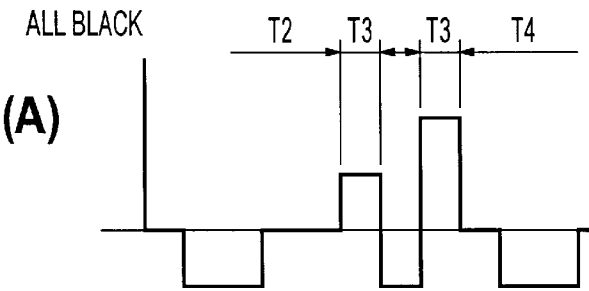
FIGS. 19(A) to 19(F) are characteristic charts showing voltages applied to the liquid crystal when each of the display patterns shown in FIGS. 3(A) to 3(F) are displayed in the second comparative example.
Figure 19B:
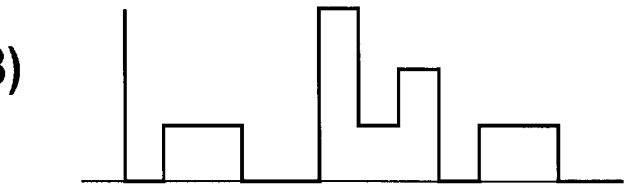
Figure 19C:
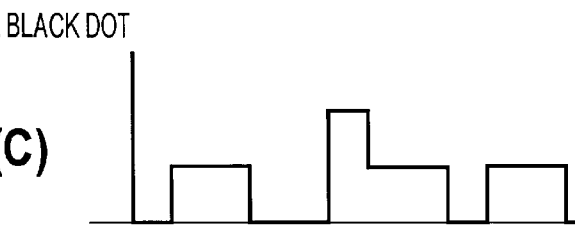
Figure 19D:
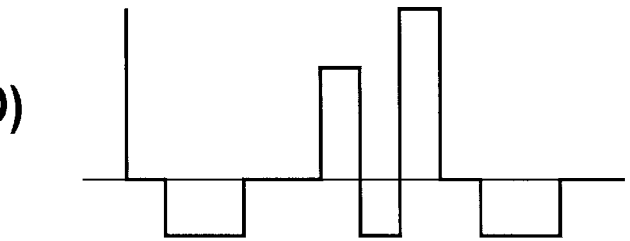
Figure 19E:
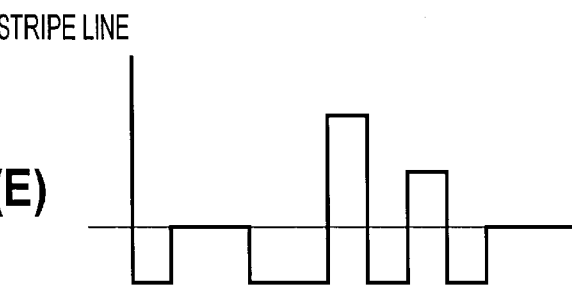
Figure 19F:
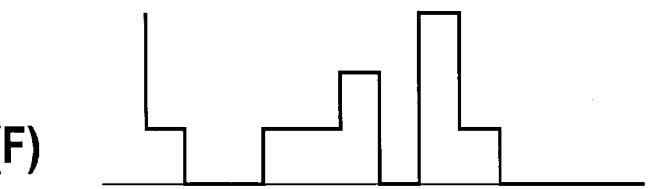

In the second comparative example, as shown in FIG. 18(A) or FIG. 18(B), a scanning signal has two selection periods T3, each having a 1H length. The signal has a potential of 0 V between the two selection periods T3, which is the same as in the non-selection period T4.

Data signals used in the second comparative example are shown in FIG. 18(C) to FIG. 18(H), which correspond to each of the display patterns shown in FIGS. 3(A) to 3(F). The difference signals between the scanning signal shown in FIG. 18(A) and each of the data signals shown in FIG. 18(C) to FIG. 18(H) are illustrated in FIGS. 19(A) to 19(F). In the display principle in this case, when the effective value of the voltage applied to the liquid crystal during the two selection periods T3 exceeds a predetermined value, a white dot is displayed, and when it is less than another specified value, a black dot is displayed.

It is understood from the comparison with the first comparative example shown in FIGS. 13(A)–(G) that the second comparative example shown in FIGS. 18(A)–(H) has a better balance in the polarity of the voltage applied to the liquid crystal during the delay period T2. This is because a data signal waveform becomes 0 V only for a 2H period at maximum as shown in FIGS. 18(C) to 18(H), and as a result, a period is obtained in which a voltage of 0 V is applied to the liquid crystal in the delay period T2.

Even in this second comparative example, however, a voltage having one polarity, positive or negative, is applied to the liquid crystal only for a 2H period at maximum. It is considered that the following state occurred due to this condition. A driving voltage margin was not obtained for a display pattern in which only one white or black pixel exists (corresponding to FIG. 3(C) or FIG. 3(D)) as shown at the center of the lower row of FIG. 16 and at the center of the upper row of FIG. 17 in the same way as in the first comparative example. A driving voltage margin was measured with the use of the scanning signal waveform shown in FIG. 18(A) in the cases shown at the lower row of FIG. 16. A driving voltage margin was measured with the use of the scanning signal waveform shown in FIG. 18(B) in the cases shown at the upper row of FIG. 17.

Description of Second Embodiment

A driving method in a second embodiment of the present invention, which is obtained by improving the second comparative example, will be described below by referring to FIG. 20, FIGS. 21(A)–(G), and FIGS. 22(A)–(F).

Figure 20:
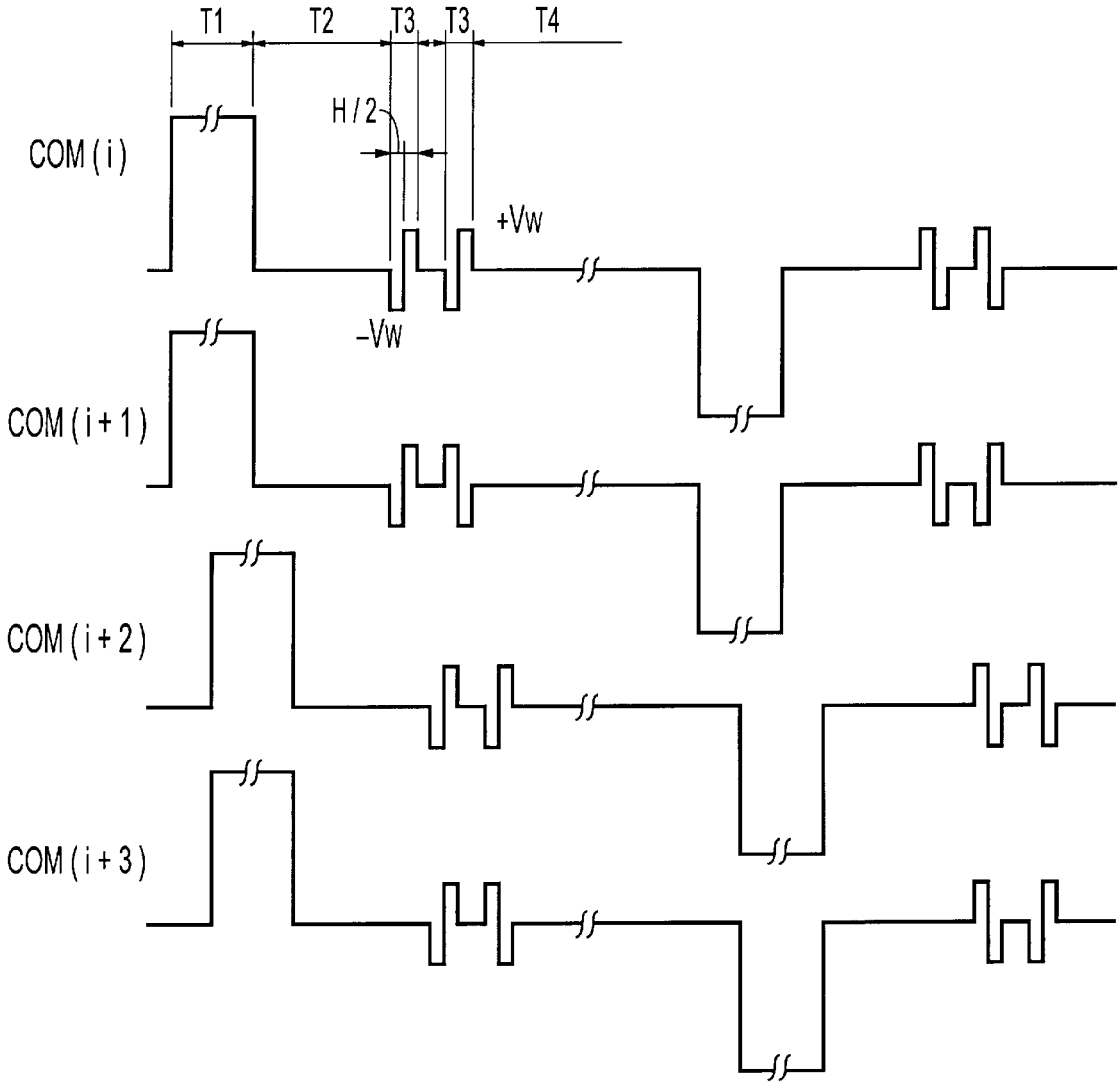
FIG. 20 is a waveform chart showing the waveforms of scanning signals used in common to display the patterns shown in FIGS. 3(A) to 3(F) in the second embodiment.
Figure 21A:
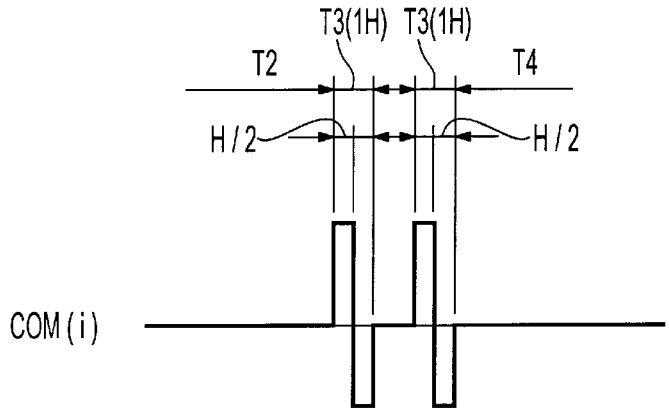
FIG. 21(A) is a waveform chart showing the waveform of scanning signals in the second embodiment.
Figure 21B:
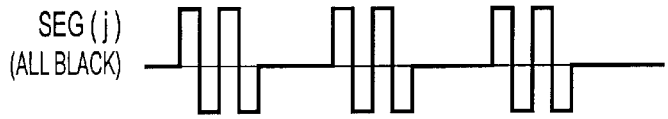
FIGS. 21(B) to 21(G) are waveform charts showing the waveforms of data signals corresponding to each of the display patterns shown in FIGS. 3(A) to 3(F) in the second embodiment.
Figure 21C:
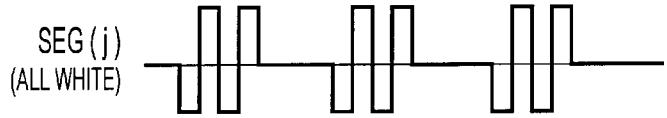
Figure 21D:
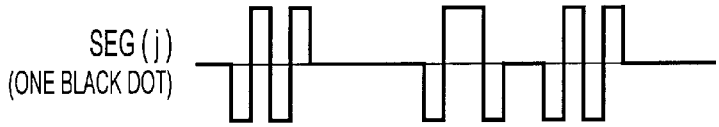
Figure 21E:
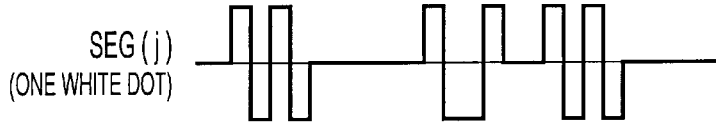
Figure 21F:
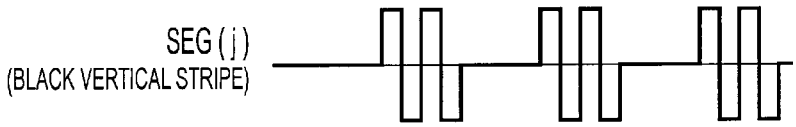
Figure 21G:
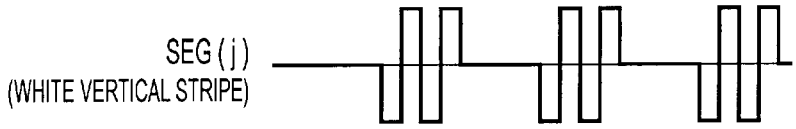
Figure 22A:
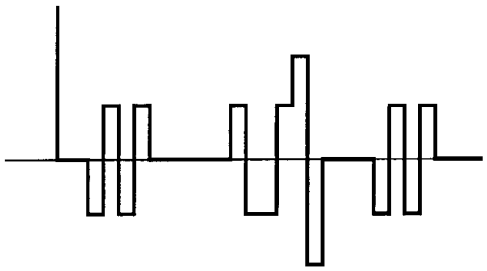
FIGS. 22(A) to 22(F) are characteristic charts showing voltages applied to the liquid crystal when each of the display patterns shown in FIGS. 3(A) to 3(F) are displayed in the second embodiment.
Figure 22B:
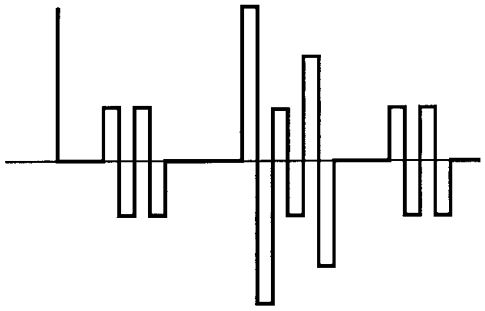
Figure 22C:
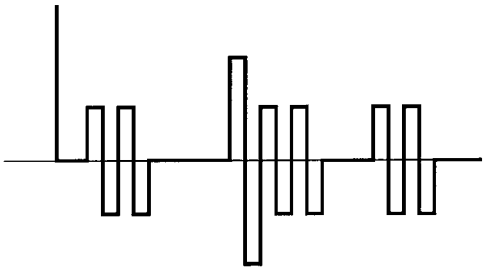
Figure 22D:
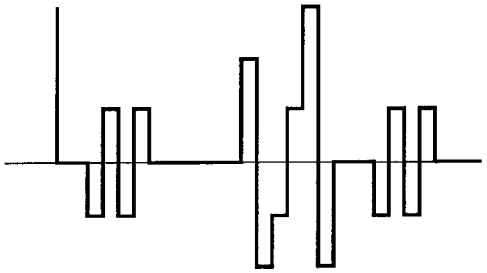
Figure 22E:
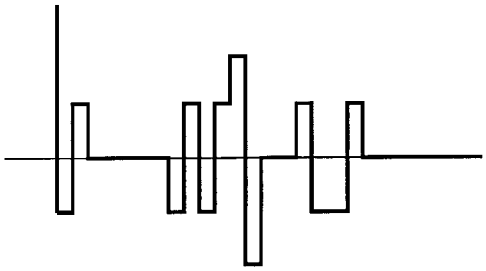
Figure 22F:
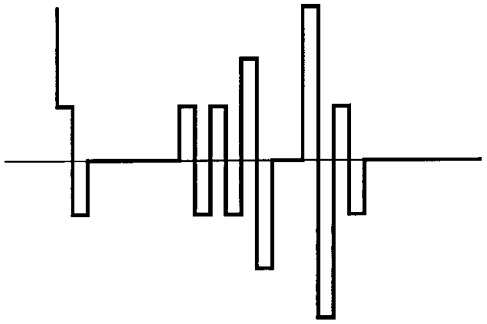

As shown in FIG. 20, in the 2LS driving method in which two lines are driven at the same time, scanning signals are used, each of which has two potential levels reversed at every 1H/2 period in the positive and negative sides as a selection potential at each of the two selection periods T3 provided for one horizontal scanning period. Between the two selection periods T3, an interval period is provided in which the signals are set to the reference potential (0 V), for example, for a 1H period. In the present embodiment, the phases of a scanning signal COM(i) and a scanning signal COM(i+1) are set to be the same. The signals differ only in the polarity of the selection potential at the second selection period T3. In the same way, the phases of a scanning signal COM(i+2) and a scanning signal COM(i+3) are set to be the same. These signals also differ only in the polarity of the selection potential at the second selection period T3.

FIG. 21 (A) shows selection potentials at the two selection periods T3 used for the above scanning signals. Data signals used in the present embodiment are shown in FIG. 21(B) to FIG. 21(G), which correspond to the display patterns shown in FIGS. 3(A) to 3(F). The difference signals between the scanning signal shown in FIG. 21(A) and each of the data signals shown in FIG. 21(B) to FIG. 21(G) are illustrated in FIGS. 22(A) to 22(F). The display principle in this case is the same as that for FIGS. 18(A)–(H). When the effective value of the voltage applied to the liquid crystal during the two selection periods T3 exceeds a predetermined value, a white dot is displayed, and when it is less than another specified value, a black dot is displayed.

It is understood from the comparison with the second comparative example shown in FIGS. 18(A)–(H) and from FIGS. 22(A)–(F) that the second embodiment has a better balance in the polarity of the voltage applied to the liquid crystal during the delay period T2. In this second embodiment, a data signal waveform becomes 0 V only for a 2H period at maximum as shown in FIGS. 21(B) to 21(G), and as a result, a period is obtained in which a voltage of 0 V is applied to the liquid crystal in the delay period T2. This is the same as for the second comparative example shown in FIGS. 18(A)–(H). In addition, in the driving method of the second embodiment, a voltage having one polarity, positive or negative, does not continue to be applied for a period exceeding a 1H period, as in the embodiment shown in FIGS. 6(A)–(H).

Figure 17:
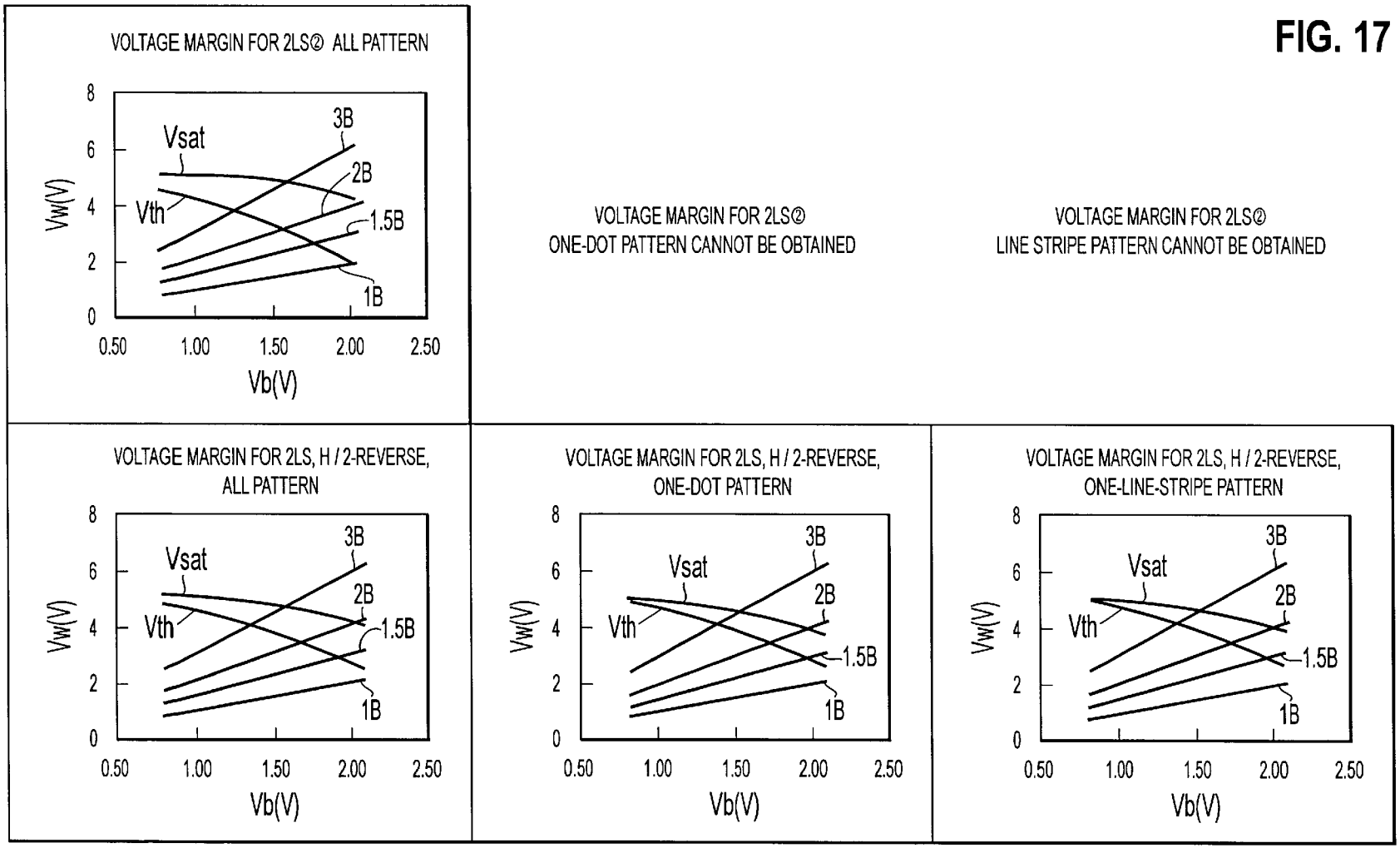
FIG. 17 is a characteristic chart showing driving voltage margins for each of the display patterns in the driving method of the second comparative example in which the selection voltage is set to have the positive and negative polarities in the two selection periods and in a driving method of the second embodiment.

With the same technique as above, driving voltage margins in a case in which the driving method of the second embodiment is employed are shown at the lower row of FIG. 17. It is clearly understood from this figure that a driving voltage margin common to the three display patterns can be obtained even in the driving method of the second embodiment.

Bias Ratio

In the characteristic charts of the driving voltage margins shown in FIGS. 15 to 17, straight lines 1B, 2B, 3B, 3.5B, and 4B indicating bias ratios are shown. These bias ratios mean the ratios of Vw to Vb. Since Vd equals Vb in each of the embodiments and comparative examples, these ratios indicate the peak value of a selection potential relative to the peak value of a data potential. 1B means that the bias ratio is one. In the same way, the numerals indicate bias ratios.

Table 1 shows the most suited bias ratio, with which the largest driving voltage margin is obtained, in each of the cases shown in FIGS. 15 to 17.

TABLE 1

| | Display Patterns and Voltage Margins | | | |
|---|---|---|---|---|
| | ALL | ONE DOT | ONE-LINE HORI-ZONTAL STRIPE | BIAS RATIO |
| COMPARATIVE EXAMPLE 1 (UPPER ROW OF FIG. 15) | 480 mV | 0 mV | 180 Mv | 3.5 BIAS |
| EMBODIMENT 1 (LOWER ROW OF FIG. 15) | 200 mV | 290 mV | 250 mV | 3 BIAS |
| EMBODIMENT 1 (UPPER ROW OF FIG. 16) | 270 mV | 240 mV | 270 mV | 3 BIAS |
| COMPARATIVE EXAMPLE 2 (LOWER ROW OF FIG. 16) | 650 mV | 0 mV | 600 mV | 1.5 BIAS |
| COMPARATIVE EXAMPLE 2 (UPPER ROW OF FIG. 17) | 450 mV | 0 mV | 0 mV | 2 BIAS |
| EMBODIMENT 2 (LOWER ROW OF FIG. 17) | 350 mV | 250 mV | 290 mV | 2 BIAS |

The driving voltage margins shown in Table 1 are the voltage margins of bias voltages Vb (equal to the data potential Vd in the present embodiment) which allow black and white display. As clearly shown in Table 1, the driving voltage margins common to the three display patterns are obtained in the embodiments 1 and 2 whereas a driving voltage margin was not obtained for a case in which only one white or black dot is displayed in one vertical line in the comparative examples 1 and 2 as described above.

With the comparison between the embodiments 1 and 2, it is found that the most suited bias ratio in the embodiment 1 is 3, which is higher than the most suited bias ratio, 2, in the embodiment 2.

Reduction in Power Consumption

Power used when the liquid crystal display device is driven will be considered next. Since a relatively high reset voltage around 25 V is applied to the liquid crystal to drive the nematic liquid crystal used in the present embodiment, power consumption is larger than that in other liquid crystal drive. Therefore, an essential issue for practical use is not to increase the power consumption.

Figure 23:
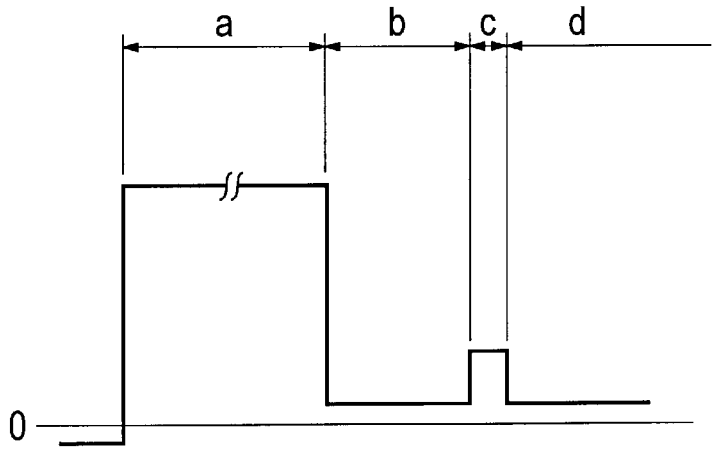
FIG. 23 is a waveform chart showing the waveform of a voltage applied to the liquid crystal in order to measure power consumption, in which the voltage is not reversed in polarity in a reset period.
Figure 24:
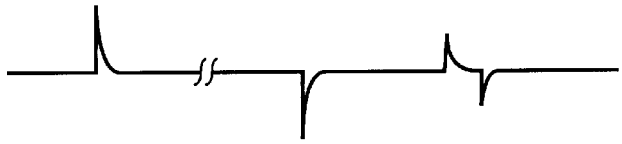
FIG. 24 is a characteristic chart showing the characteristic of a current which flows when the voltage shown in FIG. 23 is applied to the liquid crystal.

FIG. 23 shows the waveform of a voltage applied to the liquid crystal in order to measure power consumption. When the voltage shown in FIG. 23 is applied to the liquid crystal, a current flows as shown in FIG. 24 at the rising and falling edges of each of the voltages. Table 2, below, shows the maximum currents flowing at each of the periods "a" to "d" shown in FIG. 23 and FIG. 24. The maximum currents shown in Table 2 are those which flow when all pixels in a 6-inch panel are simultaneously driven.

TABLE 2

| | MAXIMUM CURRENT(A) |
|---|---|
| PERIOD a | 1.65 |
| PERIOD b | 1.63 |
| PERIOD c | 0.343 |
| PERIOD d | 0.343 |
| PERIOD e | 0.138 |

It is clearly understood from Table 2 that, since a high current flows at the rising edge of the reset voltage in the period "a" and a high current flows at the falling edge of the reset voltage in the period "b," the maximum current values are greatly larger in these periods than the other periods. A period "e" in Table 2 refers to a case in which the data potential is reversed in polarity at every 1H and the voltage waveform is superimposed at the period "d" shown in FIG. 23. Since the data potential level is sufficiently lower than the reset voltage, the maximum current also becomes low.

In the present embodiment, driving voltages such as a data potential reversed in polarity in the positive and negative sides relative to the reference potential (0 V) at an interval of 1H/2 are used. Therefore, a voltage having one polarity does not continue to be applied to the liquid crystal for a long time and also advantageously, the lifetime of the liquid crystal is extended. In general, from this viewpoint, it is preferred that the reset voltage, which is applied to the liquid crystal at the reset period, be also a voltage waveform reversed in the positive and negative sides relative to the reference potential at a predetermined timing.

Figure 25:
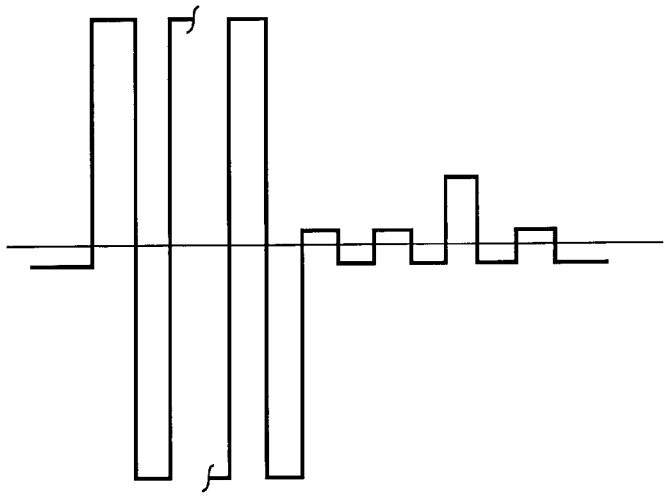
FIG. 25 is a waveform chart showing the waveform of a voltage applied to the liquid crystal in order to measure power consumption, in which the voltage is reversed in polarity at an interval of 1H in all periods.
Figure 26:
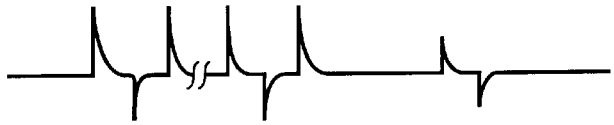
FIG. 26 is a characteristic chart showing the characteristic of a current which flows when the voltage shown in FIG. 25 is applied to the liquid crystal.

From the viewpoint of reduction in power consumption, however, the number of times the reset voltage is reversed in polarity needs to be reduced. FIG. 25 shows the waveform of a voltage applied to the liquid crystal by a conventional driving method in which the polarity is reversed at an interval of 1H. FIG. 26 shows the waveform of a current flowing when the voltage shown in FIG. 25 is applied to the liquid crystal. When the waveform of a current is compared with that shown in FIG. 24, which is used in a case in which polarity reversing drive at an interval of 1H is not used, the current in FIG. 26 increases by the amount of the current flowing every time the reset voltage is reversed in the reset period.

FIG. 26 shows a current characteristic in a case in which the polarity is reversed at an interval of 1H. When polarity reversing at an interval of 1H/2, which is applied to a potential such as a data potential in the present embodiment, is also applied to the reset period, power consumption at the reset period is doubled.

In both first and second embodiments, as shown in FIG. 4 and FIG. 20, the reset potential during the reset period is maintained to be a constant positive or negative potential and is reversed only at an interval of a frame period. Therefore, the maximum currents at the reset period and the delay period can be maintained at the values shown in the periods "a" and "b" in Table 2, and power consumption does not increase excessively.

In the embodiment 2, the non-selection period is provided between the two selection periods. The two selection periods may be set continuous for driving.

Description of Third Embodiment

As described above, it is preferred that the voltage be reversed in polarity at an interval longer than at least 1H, for example, at an interval of 2H or more in the reset period in the present invention, not at an interval of 1H/2, which is for the data potential.

Figure 29:
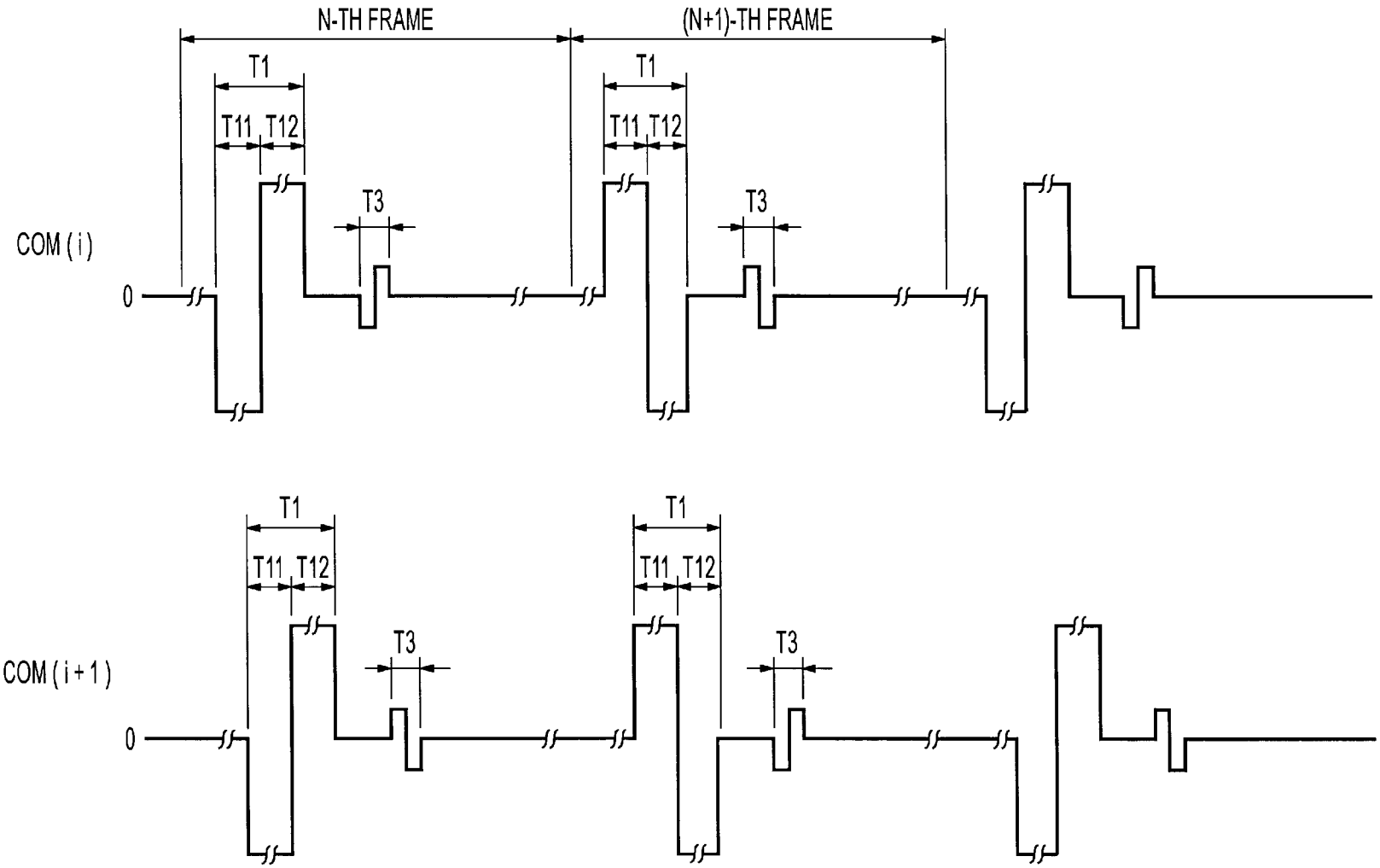
FIG. 29 is a waveform chart showing the waveforms of scanning signals according to the third embodiment of the present invention.

In the third embodiment, modified examples are shown in which the reset voltage during the reset period T1 is reversed in polarity at an interval of T1/2(>1H) as shown in FIG. 29 among the waveforms of the scanning signals shown in FIG. 4 for the first embodiment.

In FIG. 29, the reset period T1 is divided into the first half period T11 and the second half period T12 and scanning signals COM(i) and COM(i+1) include a reset voltage which has two values, one positive and one negative, relative to the intermediate value (0 V) of the amplitude of a data signal at the periods T11 and T12.

In FIG. 29, the reset voltage in the reset period T1 is reversed in polarity at an interval of a frame period. In other words, in the reset period T1 in the N-th frame, the scanning signals COM(i) and COM(i+1) are set to a negative reset voltage at the first half period T11 and set to a positive reset voltage at the second half period T12 whereas in the reset period T1 in the (N+1)-th frame, the signals are set to a positive reset voltage at the first half period T11 and set to a negative reset voltage at the second half period T12. In FIG. 29, since the positive and negative selection voltages in the selection period T3 are also reversed at an interval of a frame period, the scanning signals COM (i) and COM(i+1) become waveforms having a cycle of two frames.

Such a reset voltage waveform can also be applied to a scanning signal shown in FIG. 20 or that in MLS driving shown in FIG. 33, described later.

Description of Fourth Embodiment

Figure 30:
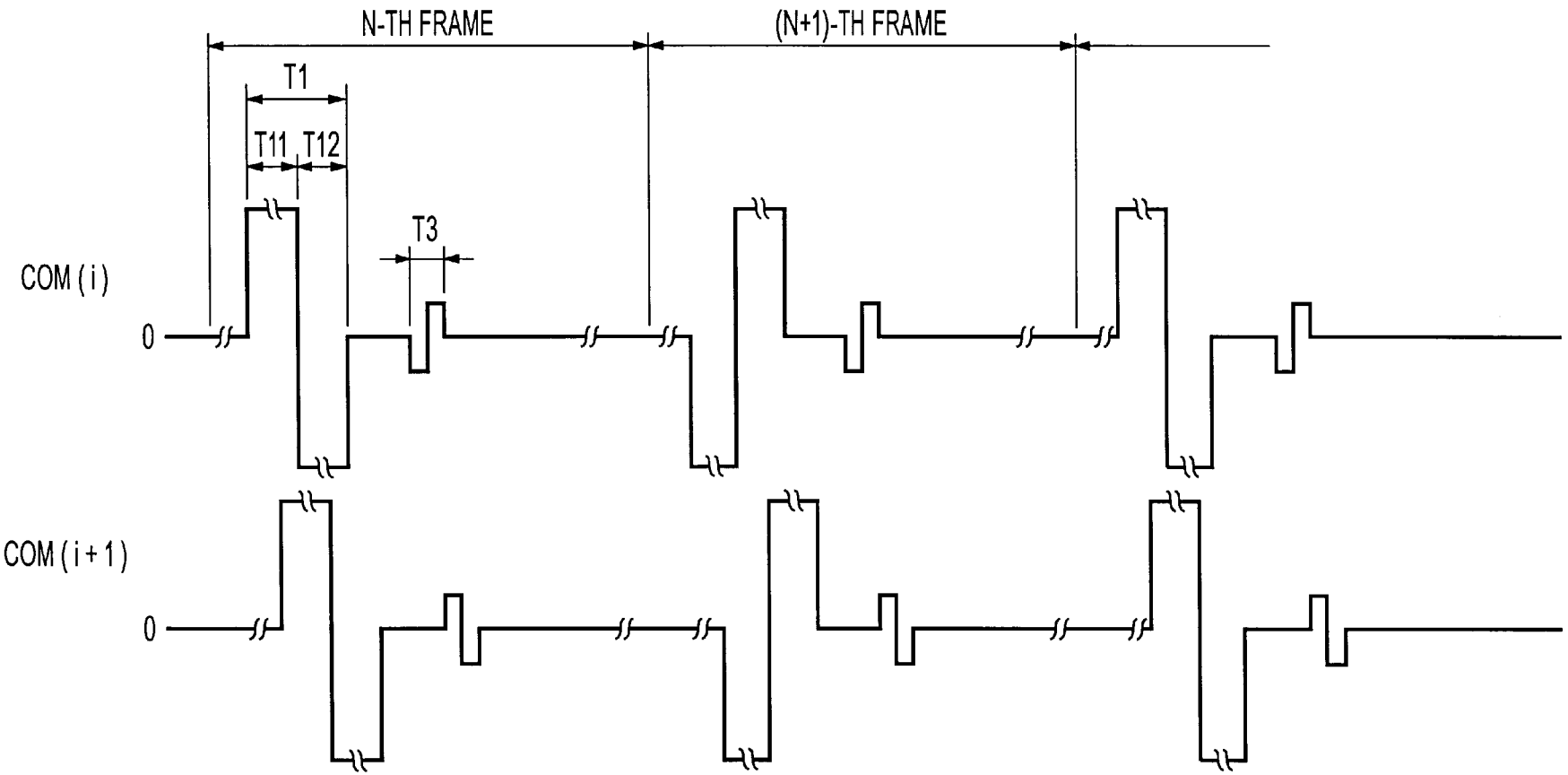
FIG. 30 is a waveform chart showing the waveforms of scanning signals according to the fourth embodiment of the present invention.

In a fourth embodiment, the reset voltage during the reset period T1 is reversed in polarity at an interval of T1/2 (>1H) in the same way as in the third embodiment. In the fourth embodiment, however, among the scanning signal waveforms shown in FIG. 29 in the third embodiment, the positive and negative selection voltages in the selection period T3 are not reversed at an interval of a frame period but reversed only at every line as shown in FIG. 30.

Description of Fifth Embodiment

In a fifth embodiment, the reset voltage during the reset period T1 is reversed in polarity at an interval longer than 1H in the same way as in the third and fourth embodiments. In the fifth embodiment, as shown in FIG. 31, the reset period T1 is divided, for example, into three portions, and a signal is set to a positive or negative reset voltage relative to the intermediate potential (0 V) of the amplitude of a data signal in the first period T1 and the third period T13, and set to the intermediate potential (0 V) at the second period T12.

In the fifth embodiment, since the reset voltage is reversed at an interval of a frame period, in the reset period T1 in the N-th frame, scanning signals COM(i) and COM(i+1) are set to a positive reset voltage at the first period T11, set to the intermediate potential (0 V) at the second period T12, and set to a negative reset voltage at the third period T13, whereas in the reset period T1 in the (N+1)-th frame, the signals are set to the negative reset voltage at the first period T11, set to the intermediate potential (0 V), and set to the positive reset voltage at the third period T13.

The reason why the signals are set to the intermediate potential (0 V) in the second period T12 of the reset period T1 will be described below by referring to FIG. 32.

Figure 31:
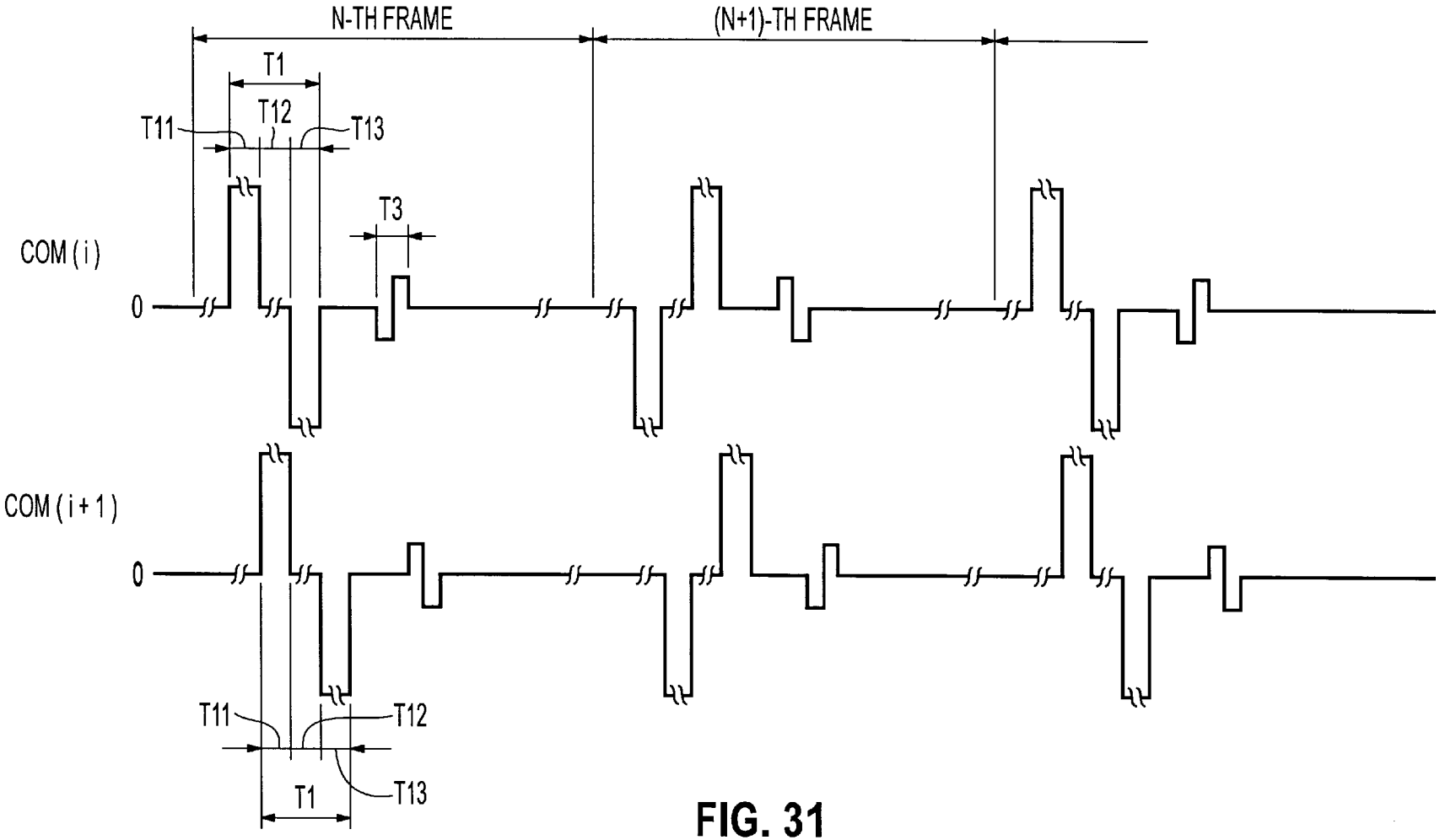
FIG. 31 is a waveform chart showing the waveforms of scanning signals according to the fifth embodiment of the present invention.
Figure 32:
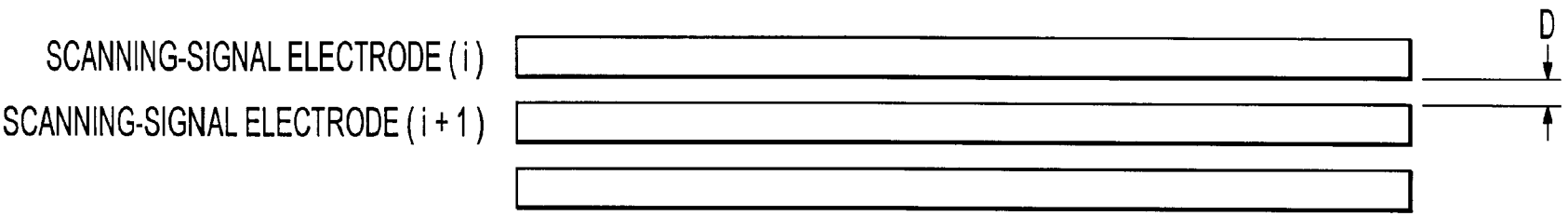
FIG. 32 is an outlined schematic diagram used for describing the distance D between scanning signal electrodes to which the scanning signal waveforms shown in FIG. 31 are supplied, and their withstand voltage.

FIG. 32 shows the i-th scanning signal electrode (i) and the (i+1)-th scanning signal electrode (i+1) to which the scanning signal COM(i) and the scanning signal COM(i+1) shown in FIG. 31 are respectively supplied. To dispose pixels in the liquid crystal display device in high density, it is necessary to narrow the distance D between electrodes shown in FIG. 32. When the distance D between electrodes is narrowed, if a high potential difference is generated between the adjacent scanning signal electrode (i) and the scanning signal electrode (i+1), a problem of the withstand voltage between the electrodes arises.

In the fifth embodiment, even in the reset period T1, in which a high potential difference is likely to be generated between adjacent electrodes, the potential difference can be suppressed to the minimum. This condition will be described with the reset period T1 in the N-th frame shown in FIG. 31 being taken as an example.

In FIG. 31, when the negative voltage (−VR) of the scanning signal COM(i) is supplied to the scanning signal electrode (i) in the third period T13 of the reset period T1, the intermediate potential (0 V) of the scanning signal COM(i+1) is supplied to the scanning signal electrode (i+1) in the second period T12. Therefore, the potential difference between the adjacent scanning signal electrodes (i) and (i+1) becomes VR. A potential difference as high as 2×VR (for example, 50 to 60 V) is not generated unlike the third and fourth embodiments.

When the positive reset voltage (+VR) of the scanning signal COM(i+1) is supplied to the scanning signal electrode (i+1) in the first period T11 of the reset period T1, the intermediate potential (0 V) of the scanning signal COM(i) is supplied to the scanning signal electrode (i) in the second period T12 of the reset period T1. Therefore, also in this case, the potential difference between the adjacent scanning signal electrodes (i) and (i+1) becomes VR.

When the negative reset voltage (−VR) of the scanning signal COM(i+1) is supplied to the scanning signal electrode (i+1) in the third period T13 of the reset period T1, the intermediate potential (0 V) of the scanning signal COM(i) is supplied to the scanning signal electrode (i) in the second period T12. Therefore, also in this case, the potential difference between the adjacent scanning signal electrodes (i) and (i+1) becomes VR.

As described above, when the scanning signal waveforms in the fifth embodiment is used, even if the distance D between adjacent scanning electrodes is narrowed to increase the pixel density, it is unnecessary to raise the withstand voltage between the electrodes very much.

As described in the above embodiments, the reset voltage during the reset period T1 are reversed in polarity at a specified interval. This interval may also be T1/M, M being an integer equal to or more than 2.

Description of Sixth Embodiment

Figure 33:
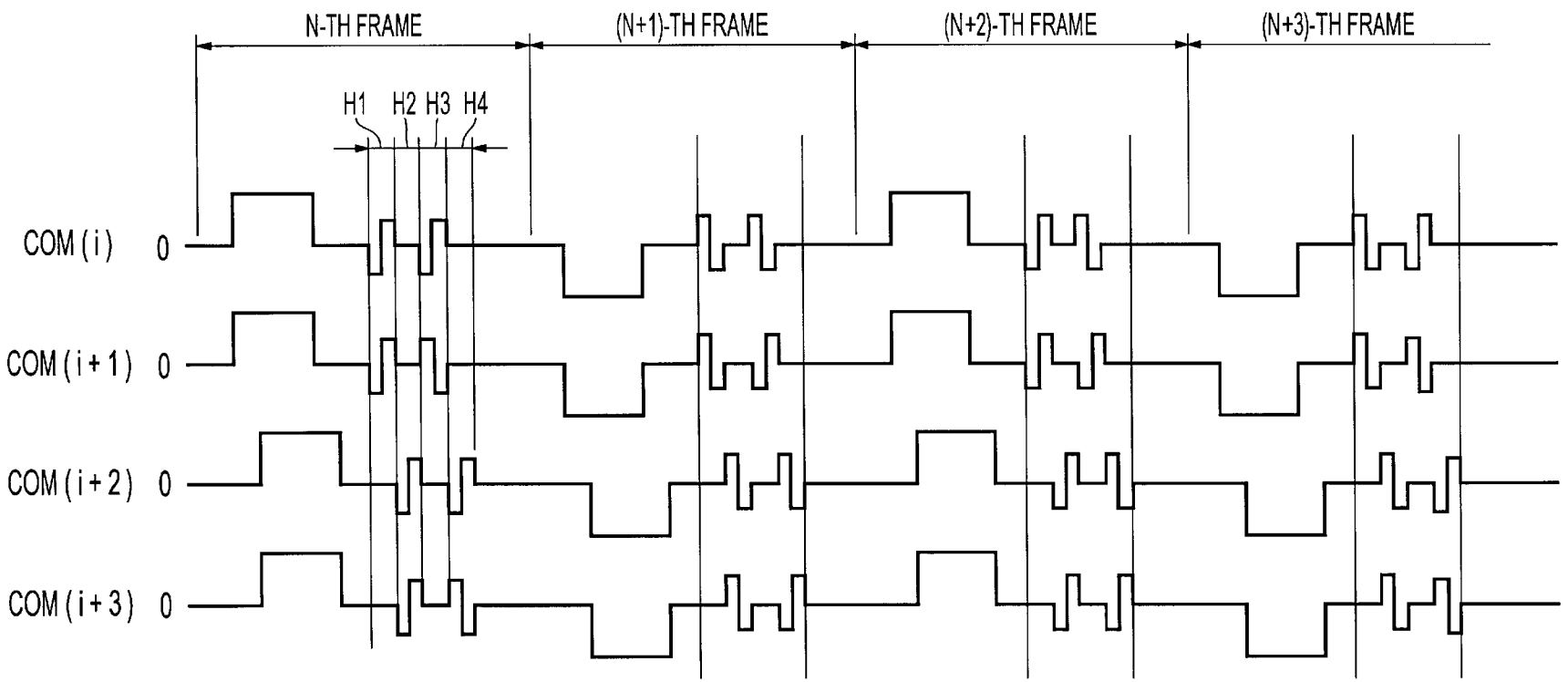
FIG. 33 is a waveform chart showing the waveforms of scanning signals according to the sixth embodiment of the present invention.

FIG. 33 shows two-line scanning signals COM(i) and COM(i+1), and COM(i+2) and COM(i+3) in a sixth embodiment, in which the present invention is applied to the 2LS driving method, the two-line simultaneous driving method. These scanning signals include first to fourth selection periods H1, H2, H3, and H4 each having a length of one horizontal scanning period (1H) in one vertical period (one frame).

The display states of the liquid crystal connected to two scanning signal electrodes to which the scanning signals COM(i) and COM(i+1) are supplied are determined by the effective voltages applied to the liquid crystal in the first selection period H1 and the third selection period H3. Therefore, the scanning signals COM(i) and COM(i+1) are set to selection potentials having two values, the positive and negative values, which are reversed in polarity at an interval of 1H/2, in the first selection period H1 and the third selection period H3. The scanning signals COM(i) and COM(i+1) are set to the same selection potentials at the first selection period H1, set to the selection potentials which are reversed each other in polarity in the third selection period H3, and set to the non-selection potential (0 V) in the second and fourth selection periods H2 and H4.

On the other hand, the display states of the liquid crystal connected to the two scanning signal electrodes to which the scanning signals COM(i+2) and COM(i+3) are supplied are determined by the effective voltages applied to the liquid crystal in the second selection period H2 and the fourth selection period H4. Therefore, the scanning signals COM (i+2) and COM(i+3) are set to selection potentials having two values, the positive and negative values, which are reversed in polarity at an interval of 1H/2, in the second selection period H2 and the fourth selection period H4. The scanning signals COM(i+2) and COM(i+3) are set to the same selection potentials at the second selection period H2, set to the selection potentials which are reversed each other in polarity in the fourth selection period H4, and set to the non-selection potential (0 V) in the first and third selection periods H1 and H3.

In the two-line scanning signals COM(i) and COM(i+1), or COM(i+2) and COM(i+3), described above, the reset potentials and the selection potentials are reversed in polarity at an interval of a frame period and the shapes of the scanning signal waveforms have a cycle of four frames.

FIG. 34 shows scanning signal waveforms, data signal waveforms, and the differential waveforms therebetween in cases of all ON and OFF combinations, namely, (on, on), (off, on), (on, off), and (off, off), in any two scanning signal lines (i, i+1). FIG. 35 shows scanning signal waveforms, data signal waveforms, and the differential waveforms therebetween in cases of all ON and OFF combinations, namely, (on, on), (off, on), (on, off), and (off, off), in the two scanning signal lines (i+2, i+3), which are selected following (i, i+1). Dotted lines in data signal waveforms indicate any data waveforms.

As clearly shown in FIG. 34, the potential of the differential waveform becomes high in either the first selection period H1 or the third selection period H3 to set the display state of the liquid crystal to an ON state in any two scanning signal lines (i) and (i+1). Therefore, the effective values of the voltages applied to the liquid crystal in the first and third selection periods H1 and H3 exceed the specified value, and the liquid crystal becomes an ON state. Conversely, when the display state of the liquid crystal is set to an OFF state, the effective values of the voltages applied to the liquid crystal in the first and third selection periods H1 and H3 do not exceed the specified value.

As clearly shown in FIG. 35, the potential of the differential waveform becomes high in either the second selection period H2 or the fourth selection period H4 to set the display state of the liquid crystal to an ON state in the two scanning signal lines (i+2) and (i+3). Therefore, the effective values of the voltages applied to the liquid crystal in the second and fourth selection periods H2 and H4 exceed the specified value, and the liquid crystal becomes an ON state. Conversely, when the display state of the liquid crystal is set to an OFF state, the effective values of the voltages applied to the liquid crystal in the second and fourth selection periods H2 and H4 do not exceed the specified value. With these settings, 2LS driving, in which two scanning signal lines are simultaneously driven, is enabled. The polarity of the voltage of the differential waveform applied to the liquid crystal is reversed at an interval shorter than 1H.

Figure 36:
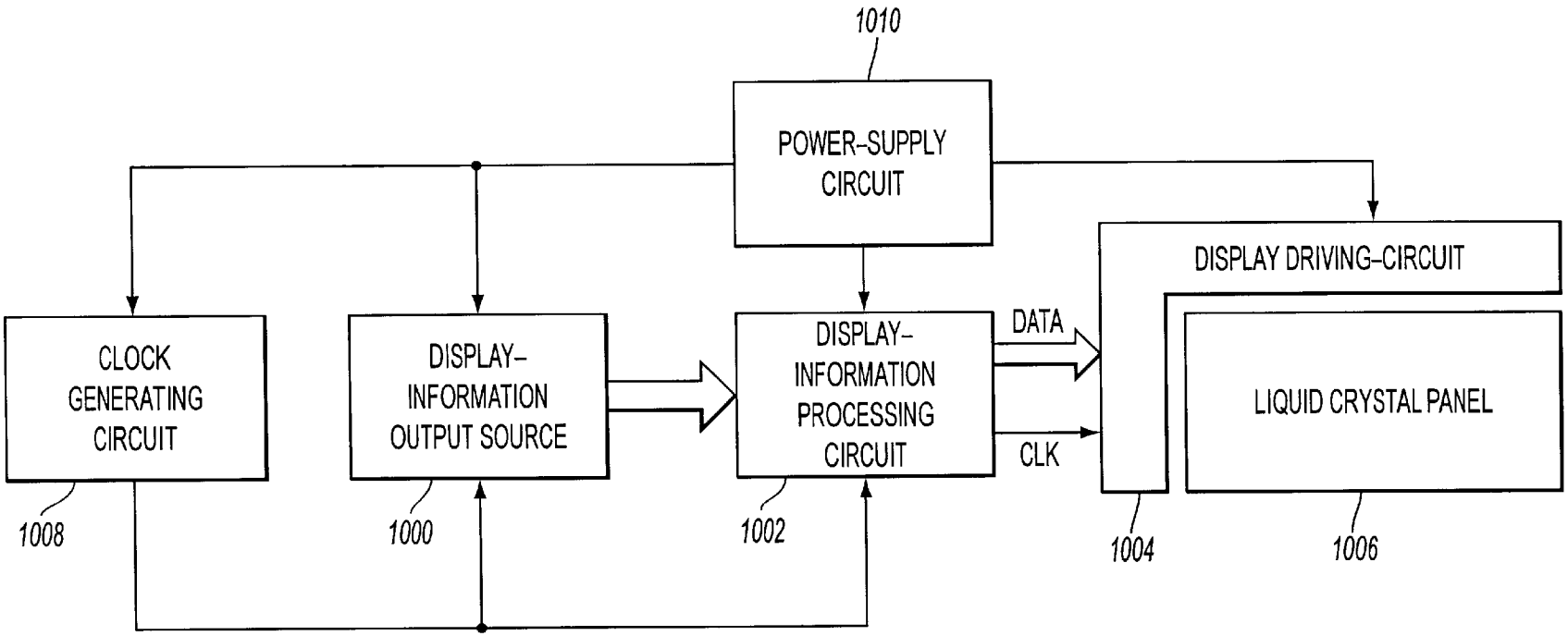
FIG. 36 is a block diagram of an electronic apparatus according to the present invention.

Description of Electronic Apparatus to which the Present Invention is Applied An electronic apparatus configured by the use of the liquid crystal display device according to the above embodiments includes a display-information output source 1000, a display-information processing circuit 1002, a display driving circuit 1004, a display panel 1006 such as a liquid crystal panel, a clock generating circuit 1008, and a power-supply circuit 1010 shown in FIG. 36. The display-information output source 1000 includes memory devices such as a ROM and a RAM, and a tuning circuit in which a TV signal is tuned and output, and outputs display information such as a video signal according to the clock sent from the clock generating circuit 1008. The display-information processing circuit 1002 processes and outputs display information according to the clock sent from the clock generating circuit 1008. This display-information processing circuit 1002 can include, for example, an amplification and polarity reversing circuit, a phase expansion circuit (serial-parallel converter circuit), a rotation circuit, a gamma correction circuit, or a clamp circuit. The display driving circuit 1004 includes a scanning side driving circuit and a data side driving circuit, and drives the liquid crystal panel 1006 for display. The power-supply circuit 1010 supplies power to each of the above circuits.

Figure 37:
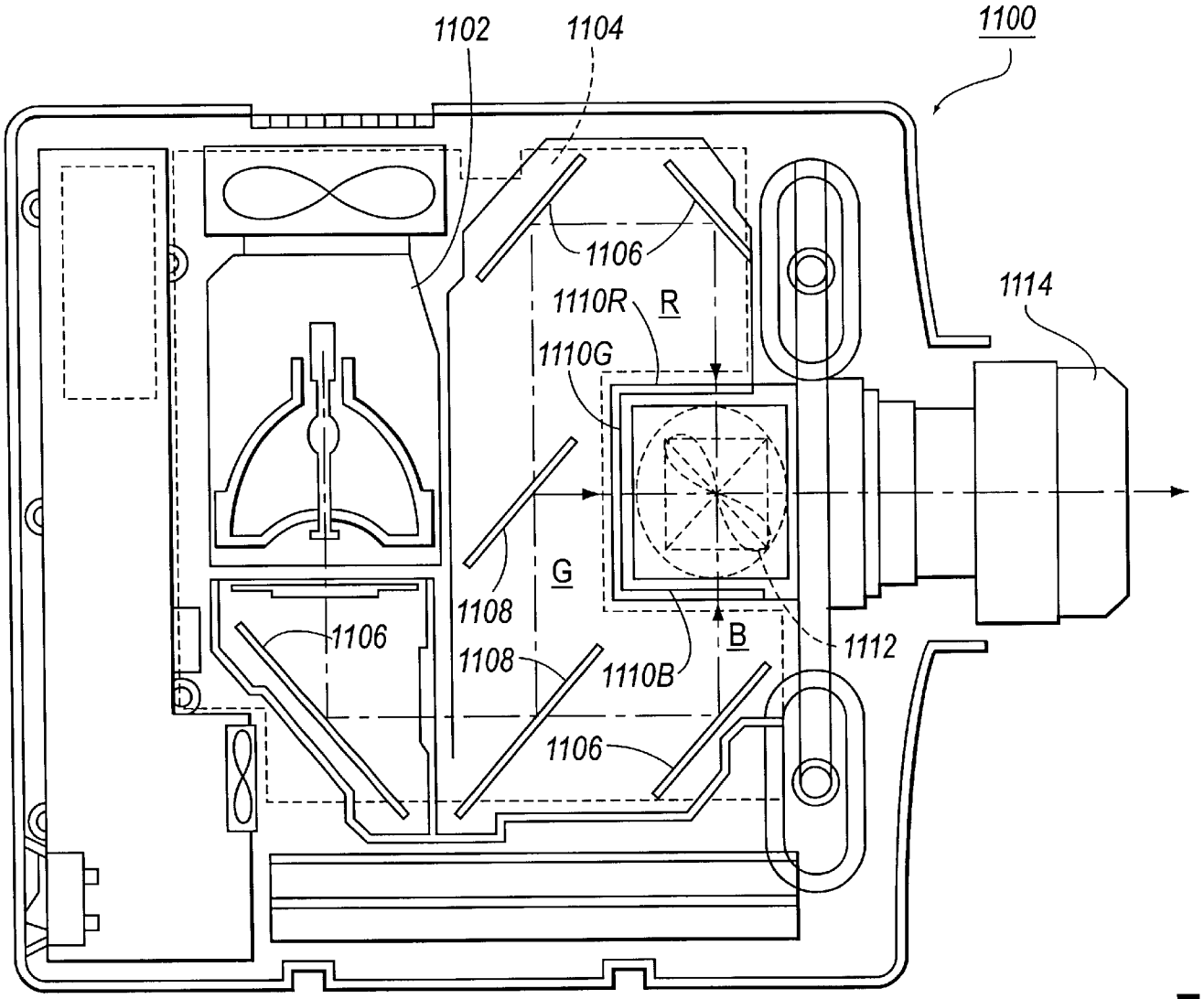
FIG. 37 is an outlined cross section of a color projector serving as an electronic apparatus.
Figure 38:
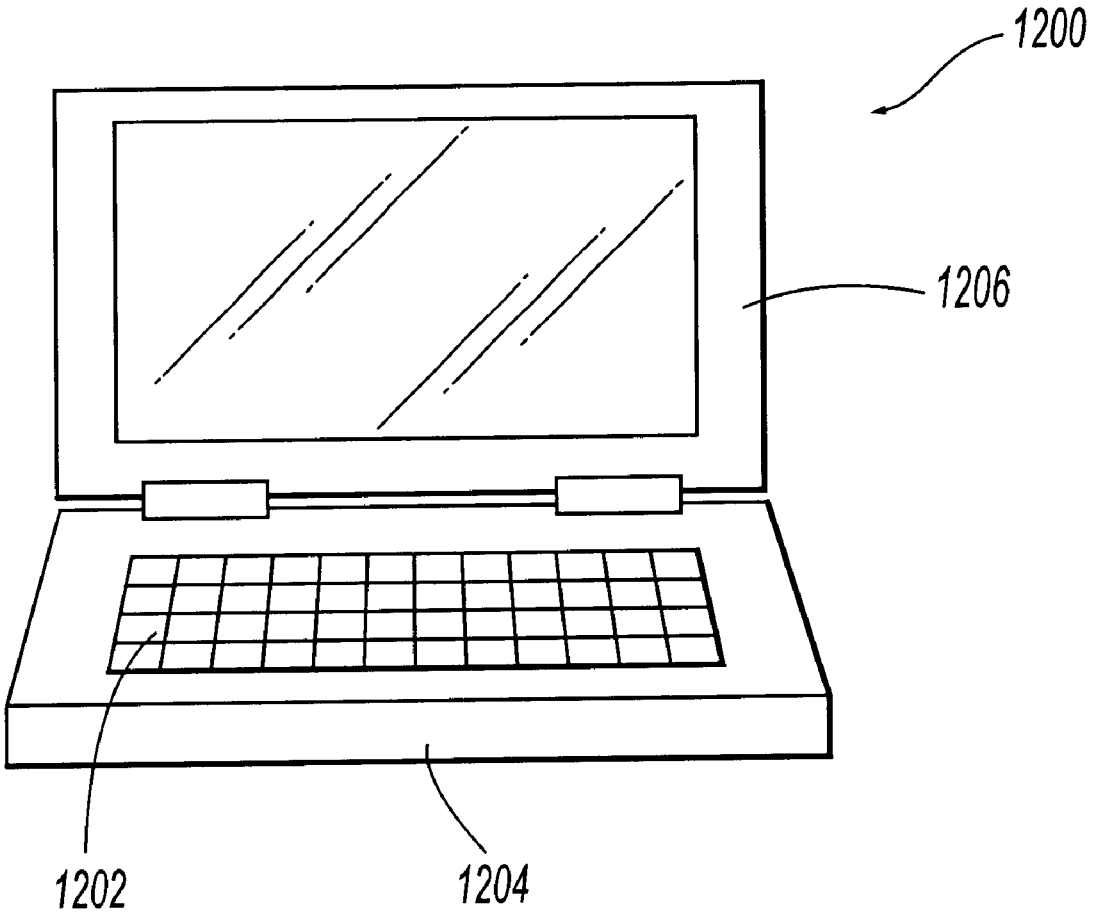
FIG. 38 is an outlined perspective view of a personal computer serving as an electronic apparatus.
Figure 39:
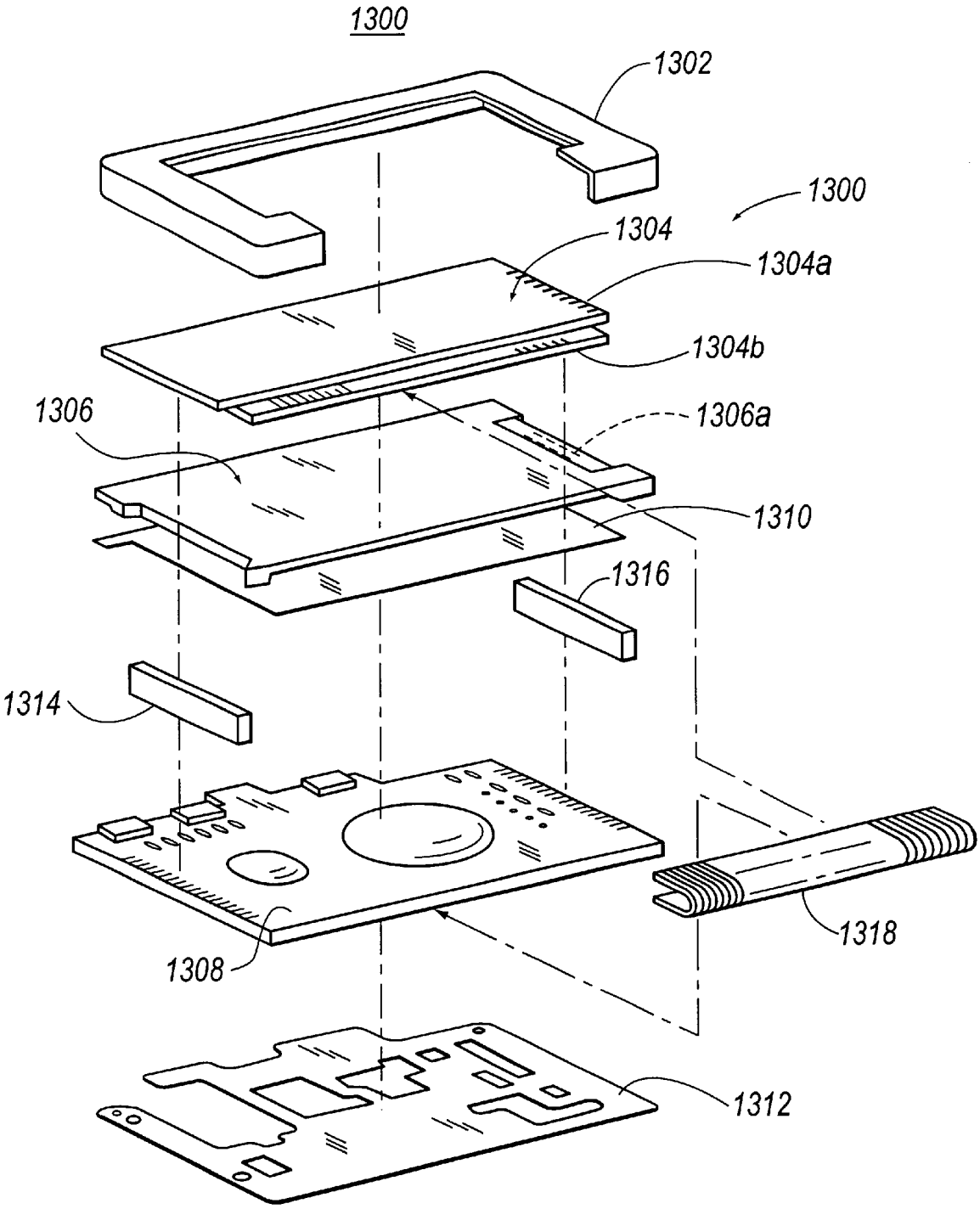
FIG. 39 is an exploded perspective view of a pager serving as an electronic apparatus.
Figure 40:
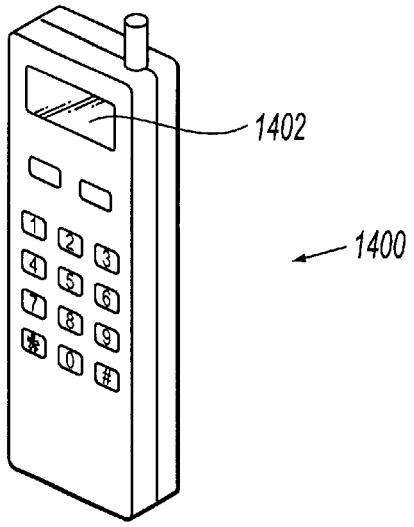
FIG. 40 is a perspective view of a portable telephone serving as an electronic apparatus.
Figure 41:
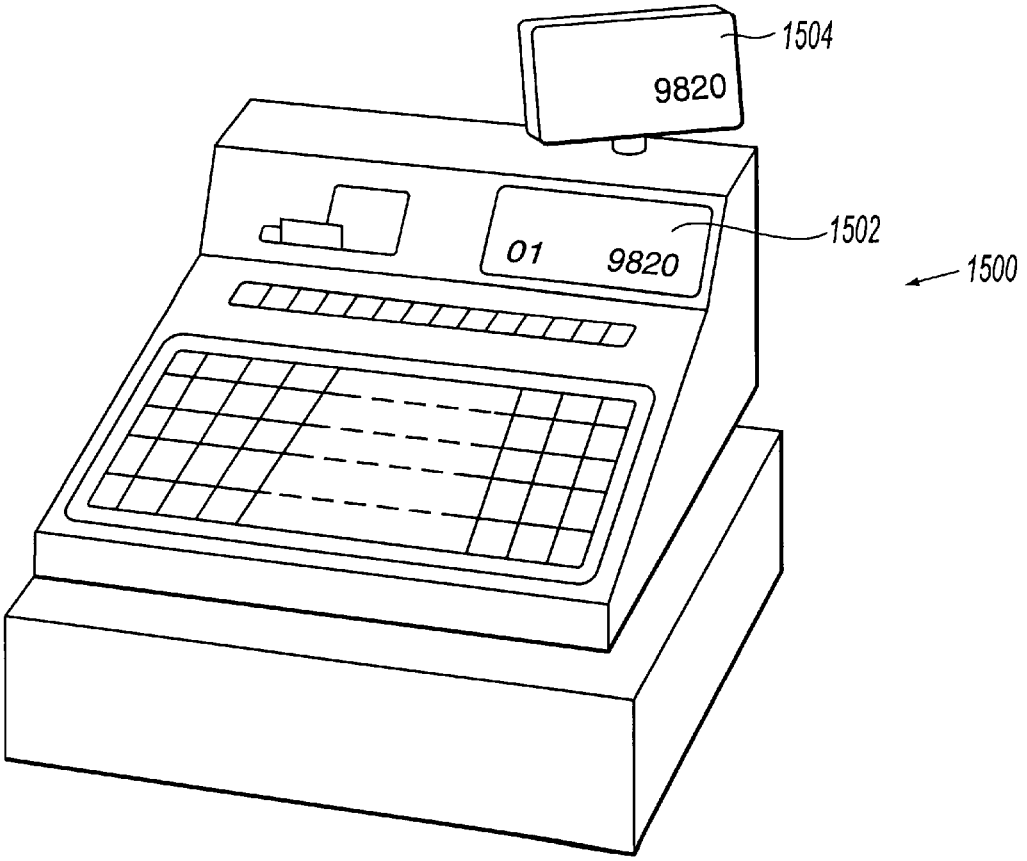
FIG. 41 is a perspective view of a register serving as an electronic apparatus.

As an electronic apparatus having such configuration, a color projector shown in FIG. 37, a personal computer (PC) for multimedia shown in FIG. 38 and an engineering workstation (EWS), a pager shown in FIG. 39, a portable terminal such as a portable telephone shown in FIG. 40, a word processor, a television set, a viewfinder-type or monitor-direct-view-type video cassette recorder, an electronic pocketbook, an electronic desktop calculator, a car navigation apparatus, a POS terminal such as a register shown in FIG. 41, and a apparatus having a touch-sensitive panel can be considered.

The color projector shown in FIG. 37 is of a projection type with a transmission-type liquid crystal panel being used as a light valve and uses, for example, a three-panel prism-type optical system.

In FIG. 37, in a projector 1100, projection light emitted from a white-light-source lamp apparatus 1102 is divided into the three primary colors, R, G, and B by a plurality of mirrors 1106 and two dichroic mirrors 1108 inside a light guide 1104 and the colors are led to three liquid crystal panels 1110R, 1110G, and 1110B, each of which displays an image in the corresponding color. Light modulated by the liquid crystal panels 1110R, 1110G, and 1110B is incident upon a dichroic prism 1112 in three directions. Since red R light and blue B light are curved by 90 degrees and green G light goes straight in the dichroic prism 1112, the images in the colors are combined and a color image is projected onto a screen through a projection lens 1114.

A personal computer 1200 shown in FIG. 38 has a body 1204 provided with a keyboard 1202 and a liquid crystal display screen 1206.

A pager 1300 shown in FIG. 39 has a liquid crystal display board 1304, a light guide 1306 provided with a backlight 1306*a*, a circuit board 1308, first and second shielding plates 1310 and 1312, two elastic conductive materials 1314 and 1316, and a film carrier tape 1318 in a metal frame 1302. The two elastic conductive materials 1314 and 1316 and the film carrier tape 1318 are used to connect the liquid crystal display substrate 1304 to the circuit substrate 1308.

The liquid crystal display substrate 1304 is formed by sealing liquid crystal between two transparent substrates 1304*a* and 1304*b*. With this substrate, at least a dot-matrix-type liquid crystal display panel is formed. The driving circuit 1004 shown in FIG. 36, or the display-information processing circuit 1002 in addition to the circuit 1004 can be formed on one transparent substrate. A circuit which is not mounted on the liquid crystal display substrate 1304 is externally connected to the liquid crystal display substrate, and can be mounted on the circuit substrate 1308 in the case shown in FIG. 39.

Figure 42:
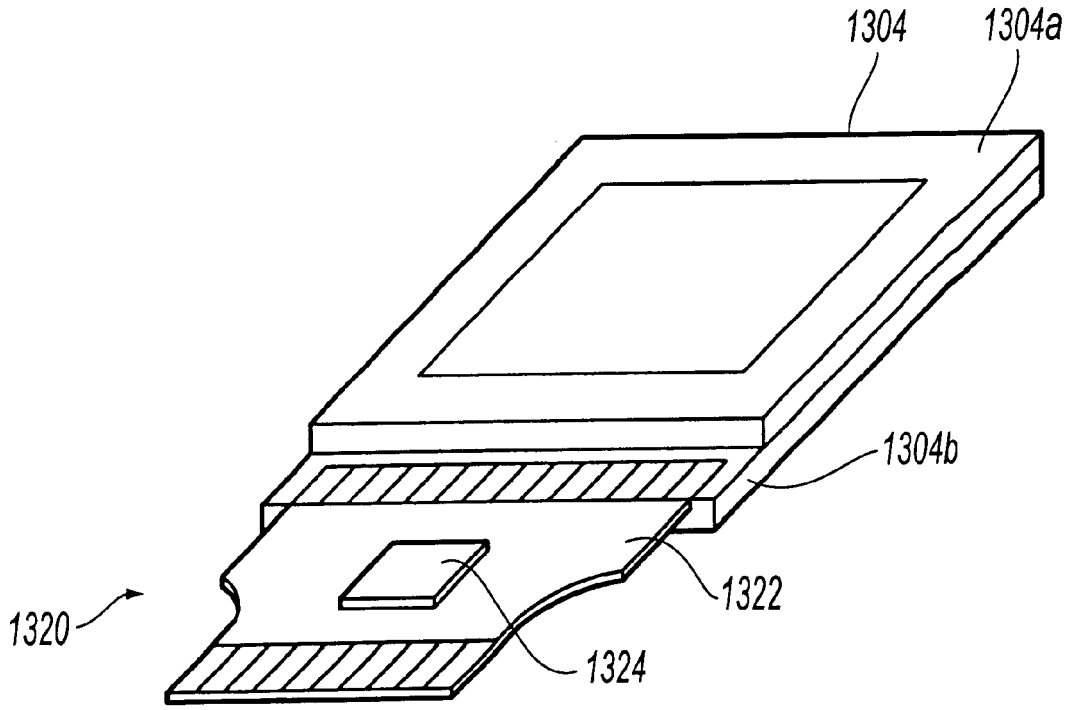
FIG. 42 is an outlined perspective view of a liquid crystal display device in which a driving circuit is connected in the TCP method.

Since FIG. 39 shows the configuration of a pager, the circuit substrate 1308 is required in addition to the liquid crystal display substrate 1304. When a liquid crystal display device is used as a part of an electronic apparatus and a display driving circuit is mounted on a transparent substrate, the minimum apparatus of the liquid crystal device is the liquid crystal display substrate 1304. Alternatively, the liquid crystal display substrate 1304 secured to the metal frame 1302 serving as a casing can be used as a liquid crystal display device serving as a part of an electronic apparatus. A liquid crystal display device of a backlight type can be configured by assembling the liquid crystal display substrate 1304 and the light guide 1306 provided with the backlight 1306*a* in the metal frame 1302. Instead of these, as shown in FIG. 42, a TCP (tape carrier package) 1320 in which an IC chip 1324 is mounted on a polyimide tape 1322 and on which a metal conductive film is formed is connected to one of the two transparent substrates 1304*a* and 1304*b* constituting the liquid crystal display substrate 1304 to form a liquid crystal display device used as a part of an electronic apparatus.

Since a portable telephone 1400 shown in FIG. 40 and a register 1500 shown in FIG. 41 have liquid crystal display sections 1402, 1502, and 1504, respectively, the present invention can also be applied to these electronic apparatuses.

The present invention is not limited to the above embodiments. Various modifications are possible within the scope of the present invention. In the above embodiments, for example, a selection potential and a data potential are reversed relative to the reference potential at an interval of 1H/2. This reverse cycle may be set to 1H/m (m is an integer equal to or more than 2). Even in a case in which the present invention is applied to MLS driving, although two lines are simultaneously selected in the above embodiments, the number of simultaneously selected lines is not limited to two. A plurality of lines need to be selected at the same time.

What is claimed is:

1. A driving method for a liquid crystal device which includes a first substrate having a plurality of scanning signal lines, a second substrate having a plurality of data signal lines, and a liquid crystal disposed between the first substrate and the second substrate, liquid crystal molecules of the liquid crystal having a predetermined twist angle at an initial state and having two metastable states different from the initial state as relaxation states achieved after a voltage that brings about a Freedericksz transition is applied, the method comprising:

supplying a scanning signal having a reset period, a delay period, at least one selection period having a length of one horizontal scanning period 1H, and a non-selection period in one vertical scanning period to the scanning signal lines, the scanning signal setting to a reset potential in the reset period, a selection potential in the at least one selection period and a non-selection potential in the delay period and the non-selection period:

supplying a data signal having a data potential corresponding to a display pattern to the data signal lines in the at least one selection period, a voltage difference between the scanning signal and the data signal being applied to the liquid crystal during the vertical scanning period;

applying a reset voltage to the liquid crystal based on the voltage difference for bringing about the Freedericksz transition in the reset period;

applying a delay voltage to the liquid crystal based on the voltage difference in the delay period after the reset period;

applying a selection voltage to the liquid crystal based on the voltage difference for setting one of the two metastable states in the at least one selection period after the delay period;

applying a non-selection voltage to the liquid crystal based on the voltage difference in the non-selection period after the at least one selection period;

reversing the selection potential of the scanning signal with respect to a reference potential at least one time within the horizontal scanning period and setting the data potential of the data signal to one of positive potential level and negative potential level with respect to the reference potential in response to the polarity of the selection potential so that the voltage difference with one polarity is not applied to the liquid crystal exceeding one horizontal scanning period 1H in the delay period, the selection period and the non-selection period; and maintaining the polarity of the reset voltage during at least two horizontal scanning periods within the reset period and reversing the polarity of the reset voltage within said vertical scanning period at an interval equal to or more than two horizontal scanning periods.

2. The driving method for the liquid crystal device according to claim 1, the reset potential of the scanning signal being set to a positive constant potential or a negative constant potential relative to the reference potential in the reset period and the reset voltage being reversed in polarity in the positive side and the negative side at an interval of the one vertical scanning period.

3. A driving method for a liquid crystal device which includes a first substrate having a plurality of scanning signal lines, a second substrate having a plurality of data signal lines, and a liquid crystal disposed between the first substrate and the second substrate, liquid crystal molecules of the liquid crystal having a predetermined twist angle at an initial state and having two metastable states different from the initial state as relaxation states achieved after a voltage that brings about a Freedericksz transition is applied, the method comprising:

supplying a scanning signal having a reset period, a delay period, at least one selection period and a non-selection period in one vertical scanning period to each of the scanning signal lines, the scanning signal setting to a reset potential in the reset period, a selection potential in the at least selection period and a non-selection potential in the delay period and the non-selection period;

supplying a data signal having a data potential corresponding to a display pattern to each of the data signal lines every time in the at least one selection period, a voltage;

applying a voltage difference between the scanning signal and the data signal to the liquid crystal during the vertical scanning period;

applying a reset voltage to the liquid crystal based on the voltage difference for bringing about the Freedericksz transition in the reset period;

applying a delay voltage to the liquid crystal based on the voltage difference in the delay period after the reset period;

applying a selection voltage to the liquid crystal based on the voltage difference for selecting one of the two metastable states in the at least one selection period after the delay period;

applying a non-selection voltage to the liquid crystal based on the voltage difference in the non-selection period following the at least one selection period;

setting the length of the at least one selection period to one horizontal scanning period 1H respectively, and setting the selection potential of the scanning signal and the data potential of the data signal corresponding to each selection period to positive potential level and negative potential level reversed in a positive side and a negative side with respect to a reference potential at an interval of 1H/m, m being an integer equal to or more than 2, so that a voltage of one polarity is not applied to the liquid crystal exceeding one horizontal scanning period 1H irrespective of the display pattern in the delay period, the selection period and the non-selection period; and reversing the reset voltage in polarity in the positive side and the negative side at an interval of a period longer than the one horizontal scanning period 1H, wherein the reset potential of the scanning signal is set to a plurality of potential levels reversed in the positive side and the negative side with respect to the reference potential in the reset period, the reset period has a length T1, and the polarity of the reset voltage applied to the liquid crystal in the reset period is reversed in the positive side and the negative side at an interval of T1/M, M is an integer equal to or more than 2, and T1/M is longer than or equal to two horizontal scanning periods.

4. The driving method for the liquid crystal device according to claim 3, the reset period of the scanning signal being divided into a plurality of periods which include at least a first period, a second period and a third period, and the scanning signal being set to positive potential level and negative potential level having polarities different from each other relative to the reference potential in the first period and the third period and being set to the reference potential in the second period.

5. The driving method for the liquid crystal device according to claim 1, wherein the scanning signal having a plurality of selection periods in the one vertical scanning period and the selection voltage is simultaneously applied to the liquid crystal connected to a plurality of different scanning signal lines in each selection period; and the each data potential of the data signal corresponding to the each selection period of the scanning signal is set to positive level and negative potential level reversed in the positive side and the negative side with respect to the reference potential at an interval of 1H/m and m being an integer equal to or more than 2.

6. The driving method for the liquid crystal device according to claim 5, the scanning signal having an interval period in which the scanning signal is set to the reference potential between two of the plurality of selection periods provided in the one vertical period.

7. The driving method for the liquid crystal device according to claim 1, wherein the length of the delay period is set from 210 $\mu$sec to 700 $\mu$sec.

8. A liquid crystal device, comprising:

a first substrate having a plurality of scanning signal lines;

a second substrate having a plurality of data signal lines;

a liquid crystal sandwiched between the first substrate and the second substrate, liquid crystal molecules of the liquid crystal having a predetermined twist angle at an initial state and having two metastable states different from the initial state as relaxation states achieved after a voltage that brings about a Freedericksz transition is applied;

scanning signal supplying device that supplies a scanning signal having a reset period, a delay period, at least one selection period having a length of one horizontal scanning period 1H, and a non-selection period in one vertical scanning period to the scanning signal lines, the scanning signal setting to a reset potential in the reset period, a selection potential in the at least selection period and a non-selection potential in the delay period and the non-selection period; and data signal supplying device that supplies a data signal having a data potential corresponding to a display pattern to the data signal lines in the at least one selection period, wherein the voltage difference between the scanning signal and the data signal is applied to the liquid crystal by the scanning signal supplying device and the data signal supplying device in one vertical scanning period so that a reset voltage for bringing about the Freedericksz transition is applied to the liquid crystal in the reset period, a delay voltage is applied to the liquid crystal in the delay period after the reset period, a selection voltage for selecting one of the two metastable states is applied to the liquid crystal in the at least one selection period after the delay period, a non-selection voltage is applied to the liquid crystal in the non-selection period after the at least one selection period, the scanning signal supplying device and the data signal supplying device reverse the selection potential of the scanning signal with respect to a reference potential at least one time within the horizontal scanning period and set the data potential of the data signal to positive potential level or negative potential level with respect to the reference potential in response to the polarity of the selection potential so that the difference voltage with one polarity is not applied to the liquid crystal exceeding one horizontal scanning period 1H in the delay period, the selection period and the non-selection period, and the scanning signal supplying device and the data signal supplying device maintain the polarity of the reset voltage during at least two horizontal scanning periods within the reset period and reverse the polarity of the reset voltage within said vertical scanning period at an interval equal to or more than two horizontal scanning periods.

9. The liquid crystal device according to claim 8, wherein the scanning signal supplying device and the data signal supplying device set the reset potential of the scanning signal to a positive constant potential or a negative constant potential with respect to the reference potential in the reset period, thereby reversing the polarity of the reset voltage in the positive side and the negative side at an interval of the one vertical scanning period.

10. A liquid crystal device, comprising:

a first substrate having a plurality of scanning signal lines;

a second substrate having a plurality of data signal lines;

a liquid crystal sandwiched between the first substrate and the second substrate, liquid crystal molecules of the liquid crystal having a predetermined twist angle at an initial state and having two metastable states different from the initial state as relaxation states achieved after a voltage that brings about a Freedericksz transition is applied;

scanning signal supplying device that supplies a scanning signal having a reset period, a delay period, at least one selection period having a length of one horizontal scanning period 1H, and a non-selection period in one vertical scanning period to each of the scanning signal lines, the scanning signal setting to a reset potential in the reset period, a selection potential in the at least selection period and a non-selection potential in the delay period and the non-selection period; and data signal supplying device that supplies a data signal having a data potential corresponding to a display pattern to each of the data signal lines every time in the at least one selection period, wherein the voltage difference between the scanning signal and the data signal is applied to the liquid crystal by the scanning signal supplying device and the data signal supplying device in one vertical scanning period so that a reset voltage for bringing about the Freedericksz transition is applied to the liquid crystal in the reset period, a delay voltage is applied to the liquid crystal in the delay period after the reset period, a selection voltage for selecting one of the two metastable states is applied to the liquid crystal in the at least one selection period after the delay period, a non-selection voltage is applied to the liquid crystal in the non-selection period following the at least one selection period, the scanning signal supplying device and the data signal supplying device also set the selection potential of the scanning signal and the data signal corresponding to each selection period respectively to positive potential level and negative potential level reversed in the positive side and the negative side with respect to a reference potential at an interval of 1H/m, m being an integer equal to or more than 2, so that a voltage of one polarity is not applied to the liquid crystal exceeding a period of 1H irrespective of the display pattern in the delay period, the selection period and the non-selection period, the scanning signal supplying device and the data signal supplying device reverse the polarity of the reset voltage in the positive side and the negative side at an interval of a period longer than the one horizontal scanning period 1H, and the scanning signal supplying device and the data signal supplying device set the reset potential of the scanning signal to a plurality of potential levels reversed in the positive side and the negative side with respect to the reference potential in the reset period, the reset period has a length of T1, and the polarity of the reset voltage applied to the liquid crystal in the reset period is reversed in the positive side and the negative side at an interval of T1/M, M is an integer equal to or more than 2, and T1/M is longer than or equal to two horizontal scanning periods.

11. The liquid crystal device according to claim 10, wherein the reset period of the scanning signal is divided into a plurality of periods which include at least a first period, a second period and a third period, and the scanning signal supplying device and the data signal supplying device set the scanning signal to a positive potential level or a negative potential level having polarities different from each other with respect to the reference potential in the first period and the third period and set the scanning signal to the reference potential in the second period.

12. The liquid crystal device according to claim 8, wherein the scanning signal having a plurality of selection periods in the one vertical scanning period and the selection voltage is simultaneously applied to the liquid crystal connected to a plurality of different scanning signal lines in each selection period, and each of the data potentials of the data signal corresponding to the each selection period of the scanning signal is set to positive level and negative potential level reversed in the positive side and the negative side with respect to the reference potential at an interval of 1H/m and m being an integer equal to or more than 2.

13. The liquid crystal device according to claim 12, the scanning signal having an interval period in which the scanning signal is set to the reference potential between two of the plurality of selection periods provided in the one vertical period.

14. The liquid crystal device according to claim 8, wherein the length of the delay period is set from 210 $\mu$sec to 700 sec.

15. An electronic apparatus containing a liquid crystal device, the liquid crystal device comprising:

a first substrate having a plurality of scanning signal lines;

a second substrate having a plurality of data signal lines;

a liquid crystal sandwiched between the first substrate and the second substrate in which a liquid crystal molecule has a predetermined twist angle at an initial state and has two metastable states different from the initial state as relaxation states achieved after a voltage that brings about a Freedericksz transition is applied;

scanning signal supplying device that supplies a scanning signal having a reset period, a delay period, at least one selection period having a length of one horizontal scanning period 1H, and a non-selection period in one vertical scanning period to the scanning signal lines, the scanning signal setting to a reset potential in the reset period, a selection potential in the at least selection period and a non-selection potential in the delay period and the non-selection period; and data signal supplying device that supplies a data signal having a data potential corresponding to a display pattern to the data signal lines in the at least one selection period, wherein the voltage difference between the scanning signal and the data signal is applied to the liquid crystal by the scanning signal supplying device and the data signal supplying device in one vertical scanning period so that a reset voltage for bringing about the Freedericksz transition is applied to the liquid crystal in the reset period, a delay voltage is applied to the liquid crystal in the delay period after the reset period, a selection voltage for selecting one of the two metastable states is applied to the liquid crystal in the at least one selection period after the delay period, a non-selection voltage is applied to the liquid crystal in the non-selection period after the at least one selection period, the scanning signal supplying device and the data signal supplying device reverse the selection potential of the scanning signal with respect to a reference potential at least one time within the horizontal scanning period and set the data potential of the data signal to positive potential level or negative potential level with respect to the reference potential in response to reversing timing of the selection potential so that the difference voltage with one polarity is not applied to the liquid crystal exceeding one horizontal scanning period 1H in the delay period, the selection period and the non-selection period, and the scanning signal supplying device and the data signal supplying device maintain the polarity of the reset voltage during at least two horizontal scanning periods within the reset period and reverse the polarity of the reset voltage within said vertical scanning period at an interval equal to or more than two horizontal scanning periods.

16. The electronic apparatus according to claim 15, wherein the scanning signal supplying device and the data signal supplying device set the reset potential of the scanning signal to a positive constant potential or a negative constant potential with respect to the reference potential in the reset period, thereby reversing the polarity of the reset voltage in the positive side and the negative side at an interval of the one vertical scanning period.

17. An electronic apparatus containing a liquid crystal device, the liquid crystal device comprising:

a first substrate having a plurality of scanning signal lines;

a second substrate having a plurality of data signal lines;

a liquid crystal sandwiched between the first substrate and the second substrate in which a liquid crystal molecule has a predetermined twist angle at an initial state and has two metastable states different from the initial state as relaxation states achieved after a voltage that brings about a Freedericksz transition is applied;

scanning signal supplying device that supplies a scanning signal having a reset period, a delay period, at least one selection period having a length of one horizontal scanning period 1H, and a non-selection period in one vertical scanning period to each of the scanning signal lines, the scanning signal setting to a reset potential in the reset period, a selection potential in the at least selection period and a non-selection potential in the delay period and the non-selection period; and data signal supplying device that supplies a data signal having a data potential corresponding to a display pattern to each of the data signal lines every time in the at least one selection period, wherein the different voltage between the scanning signal and the data signal is applied to the liquid crystal by the scanning signal supplying device and the data signal supplying device in one vertical scanning period so that a reset voltage for bringing about the Freedericksz transition is applied to the liquid crystal in the reset period, a delay voltage is applied to the liquid crystal in the delay period after the reset period, a selection voltage for selecting one of the two metastable states is applied to the liquid crystal in the at least one selection period after the delay period, a non-selection voltage is applied to the liquid crystal in the non-selection period following the at least one selection period, the scanning signal supplying device and the data signal supplying device also set the selection potential of the scanning signal and the data signal corresponding to each selection period respectively to positive potential level and negative potential level reversed in the positive side and the negative side with respect to a reference potential at an interval of 1H/m, m being an integer equal to or more than 2, so that a voltage of one polarity is not applied to the liquid crystal exceeding a period of 1H irrespective of the display pattern in the delay period, the selection period and the non-selection period, the scanning signal supplying device and the data signal supplying device reverse the polarity of the reset voltage in the positive side and the negative side at an interval of a period longer than the one horizontal scanning period 1H, and the scanning signal supplying device and the data signal supplying device set the reset potential of the scanning signal to a plurality of potential levels reversed in the positive side and the negative side with respect to the reference potential in the reset period, the reset period has a length of T1, and the polarity of the reset voltage applied to the liquid crystal in the reset period is reversed in the positive side and the negative side at an interval of T1/M, M is an integer equal to or more than 2, and T1/M is longer than or equal to two horizontal scanning periods.

18. The electronic apparatus according to claim 17, wherein the reset period of the scanning signal is divided into a plurality of periods which include at least a first period, a second period and a third period, and the scanning signal supplying device and the data signal supplying device set the scanning signal to a positive potential level or a negative potential level having polarities different from each other with respect to the reference potential in the first period and the third period and set the scanning signal to the reference potential in the second period.

19. The electronic apparatus according to claim 15, wherein the scanning signal having a plurality of selection periods in the one vertical scanning period and the selection voltage is simultaneously applied to the liquid crystal connected to a plurality of different scanning signal lines in each selection period, and each of the data potentials of the data signal corresponding to the each selection period of the scanning signal is set to positive level and negative potential level reversed in the positive side and the negative side with respect to the reference potential at an interval of 1Hm and m being an integer equal to or more than 2.

20. The electronic apparatus according to claim 19, the scanning signal having an interval period in which the scanning signal is set to the reference potential between two of the plurality of selection periods provided in the one vertical period.

21. The electronic apparatus according to claim 15, wherein the length of the delay period is set from 210 $\mu$sec to 700 $\mu$sec.

22. A driving method for a liquid crystal device which includes a first substrate having a plurality of scanning signal lines, a second substrate having a plurality of data signal lines, and a liquid crystal disposed between the first substrate and the second substrate, liquid crystal molecules of the liquid crystal having a predetermined twist angle at an initial state and having two metastable states different from the initial state as relaxation states achieved after a voltage that brings about a Freedericksz transition is applied, the method comprising:

supplying a scanning signal having a reset period, a delay period, at least one selection period having a length of one horizontal scanning period 1H, and a non-selection period in one vertical scanning period to the scanning signal lines, the scanning signal setting to a reset potential in the reset period, a selection potential in the at least selection period and a non-selection potential in the delay period and the non-selection period;

supplying a data signal having a data potential corresponding to a display pattern to the data signal lines in the at least one selection period, a difference voltage between the scanning signal and the data signal being applied to the liquid crystal during the vertical scanning period;

applying a reset voltage to the liquid crystal based on the difference voltage for bringing about the Freedericksz transition in the reset period;

applying a delay voltage to the liquid crystal based on the difference voltage in the delay period after the reset period;

applying a selection voltage to the liquid crystal based on the difference voltage for selecting one of the two metastable states in the at least one selection period after the delay period;

applying a non-selection voltage to the liquid crystal based on the difference voltage in the non-selection period after the at least one selection period;

reversing the selection potential of the scanning signal with respect to a reference potential at least one time within the horizontal scanning period and setting the data potential of the data signal to positive potential level or negative potential level with respect to the reference potential in response to the polarity of the selection potential so that the difference voltage with one polarity is not applied to the liquid crystal exceeding one horizontal scanning period 1H in the delay period, the selection period and the non-selection period; and dividing the reset period of the scanning signal into a plurality of periods which include at least a first period, a second period and a third period, and setting the scanning signal to a positive potential level or a negative potential level having polarities different from each other with respect to the reference potential in the first period and the third period and setting the scanning signal to the reference potential in the second period.

23. A driving method for a liquid crystal device which includes a first substrate having a plurality of scanning signal lines, a second substrate having a plurality of data signal lines, and a liquid crystal disposed between the first substrate and the second substrate, liquid crystal molecules of the liquid crystal having a predetermined twist angle at an initial state and having two metastable states different from the initial state as relaxation states achieved after a voltage that brings about a Freedericksz transition is applied, the method comprising:

supplying a scanning signal having a reset period, a delay period, at least one selection period having a length of one horizontal scanning period 1H, and a non-selection period in one vertical scanning period to the scanning signal lines, the scanning signal setting to a reset potential in the reset period, a selection potential in the at least selection period and a non-selection potential in the delay period and the non-selection period;

supplying a data signal having a data potential corresponding to a display pattern to the data signal lines in the at least one selection period, a voltage difference between the scanning signal and the data signal being applied to the liquid crystal during the vertical scanning period;

applying a reset voltage to the liquid crystal based on the difference voltage for bringing about the Freedericksz transition in the reset period;

applying a delay voltage to the liquid crystal based on the difference voltage in the delay period after the reset period;

applying a selection voltage to the liquid crystal based on the voltage difference for selecting one of the two metastable states in the at least one selection period after the delay period, wherein a selection voltage waveform applied to a scanning line selected at i has an inverse relationship with a selection voltage waveform applied to a scanning line selected at i+1, i being a number greater than 0;

applying a non-selection voltage to the liquid crystal based on the difference voltage in the non-selection period after the at least one selection period;

reversing the selection potential of the scanning signal with respect to a reference potential at least one time within the horizontal scanning period and setting the data potential of the data signal to one of positive potential level and negative potential level with respect to the reference potential in response to the polarity of the selection potential so that the difference voltage with one polarity is not applied to the liquid crystal exceeding one horizontal scanning period 1H in the delay period, the selection period and the non-selection period; and maintaining the polarity of the reset voltage during at least two horizontal scanning periods within the reset period and reversing the polarity of the reset voltage within said vertical scanning period at an interval equal to or more than two horizontal scanning periods.

24. The liquid crystal device according to claim 23, wherein the reset voltage is a constant value within one vertical scanning period and reversed with respect to a reference voltage at the vertical scanning period.

25. A liquid crystal device, comprising:

a first substrate having a plurality of data signal lines;

a second substrate having a plurality of data signal lines;

a liquid crystal sandwiched between the first substrate and the second substrate, liquid crystal molecules of the liquid crystal having a predetermined twist angle at an initial state and having two metastable states different from the initial state as relaxation states achieved after a voltage that brings about a Freedericksz transition is applied;

scanning signal supplying device that supplies a scanning signal having a reset period, a delay period, at least one selection period having a length of one horizontal scanning period 1H, and a non-selection period in one vertical scanning period to the scanning signal lines, the scanning signal setting to a reset potential in the reset period, a selection potential in the at least one selection period and a non-selection potential in the delay period and the non-selection period; and data signal supplying device that supplies a data signal having a data potential corresponding to a display pattern to the data signal lines in the at least one selection period, wherein the voltage difference between the scanning signal and the data signal is applied to the liquid crystal by the scanning signal supplying device and the data signal supplying device in one vertical scanning period so that a reset voltage for bringing about the Freedericksz transition is applied to the liquid crystal in the reset period, a delay voltage is applied to the liquid crystal in the delay period after the reset period, a selection voltage for selecting one of the two metastable states is applied to the liquid crystal in the at least one selection period after the delay period, wherein a selection voltage waveform applied to a scanning line selected at i has an inverse relationship with a selection voltage waveform applied to a scanning line selected at i+1, i being a number greater than 0, a non-selection voltage is applied to the liquid crystal in the non-selection period after the at least one selection period, the scanning signal supplying device and the data signal supplying device reverse the selection potential of the scanning signal with respect to a reference potential at least one time within the horizontal scanning period and set the data potential of the data signal to positive potential level or negative potential level with respect to the reference potential in response to the polarity of the selection potential so that the voltage difference with one polarity is not applied to the liquid crystal exceeding one horizontal scanning period 1H in the delay period, the selection period and the non-selection period, and the scanning signal supplying device and the data signal supplying device maintain the polarity of the reset voltage during at least two horizontal scanning periods within the reset period and reverse the polarity of the reset voltage within said vertical scanning period at an interval equal to or more than two horizontal scanning periods.

26. The liquid crystal device according to claim 25, wherein the reset voltage is a constant value within one vertical scanning period and reversed with respect to a reference voltage at the vertical scanning period.

27. An electronic apparatus containing a liquid crystal device, the liquid crystal device comprising:

a first substrate having a plurality of scanning signal lines;

a second substrate having a plurality of data signal lines;

a liquid crystal sandwiched between the first substrate and the second substrate in which a liquid crystal molecule has a predetermined twist angle at an initial state and has two metastable states different from the initial state as relaxation states achieved after a voltage that brings about a Freedericksz transition is applied;

scanning signal supplying device that supplies a scanning signal having a reset period, a delay period, at least one selection period having a length of one horizontal scanning period 1H, and a non-selection period in one vertical scanning period to the scanning signal lines, the scanning signal setting to a reset potential in the reset period, a selection potential in the at least selection period and a non-selection potential in the delay period and the non-selection period; and data signal supplying device that supplies a data signal having a data potential corresponding to a display pattern to the data signal lines in the at least one selection period, wherein the voltage difference between the scanning signal and the data signal is applied to the liquid crystal by the scanning signal supplying device and the data signal supplying device in one vertical scanning period so that a reset voltage for bringing about the Freedericksz transition is applied to the liquid crystal in the reset period, a delay voltage is applied to the liquid crystal in the delay period after the reset period, a selection voltage for selecting one of the two metastable states is applied to the liquid crystal in the at least one selection period after the delay period, wherein a selection voltage waveform applied to a scanning line selected at i has an inverse relationship with a selection voltage waveform applied to a scanning line selected at i+1, i being a number greater than 0, a non-selection voltage is applied to the liquid crystal in the non-selection period after the at least one selection period, the scanning signal supplying device and the data signal supplying device reverse the selection potential of the scanning signal with respect to a reference potential at least one time within the horizontal scanning period and set the data potential of the data signal to positive potential level or negative potential level with respect to the reference potential in response to reversing timing of the selection potential so that the difference voltage with one polarity is not applied to the liquid crystal exceeding one horizontal scanning period 1H in the delay period, the selection period and the non-selection period, and the scanning signal supplying device and the data signal supplying device maintain the polarity of the reset voltage during at least two horizontal scanning periods within the reset period and reverse the polarity of the reset voltage within said vertical scanning period at an interval equal to or more than two horizontal scanning periods.

28. The liquid crystal device according to claim 27, wherein the reset voltage is a constant value within one vertical scanning period and reversed with respect to a reference voltage at the vertical scanning period.

* * * * *